US011369926B2

(12) United States Patent
Yanai et al.

(10) Patent No.: US 11,369,926 B2
(45) Date of Patent: Jun. 28, 2022

(54) ULTRA FINE BUBBLE GENERATION APPARATUS

(71) Applicant: CANON KABUSHIKI KAISHA, Tokyo (JP)

(72) Inventors: Yumi Yanai, Kanagawa (JP); Masahiko Kubota, Tokyo (JP); Akira Yamamoto, Kanagawa (JP); Yoshiyuki Imanaka, Kanagawa (JP); Akitoshi Yamada, Kanagawa (JP); Hiroyuki Ishinaga, Tokyo (JP); Teruo Ozaki, Kanagawa (JP); Toshio Kashino, Kanagawa (JP); Ikuo Nakazawa, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/162,117

(22) Filed: Jan. 29, 2021

(65) Prior Publication Data

US 2021/0245117 A1 Aug. 12, 2021

(30) Foreign Application Priority Data

Feb. 12, 2020 (JP) ..... JP2020-021438

(51) Int. Cl.

| | |
|---|---|
| ***B01F 23/23*** | (2022.01) |
| ***B01F 23/232*** | (2022.01) |
| ***B01F 35/93*** | (2022.01) |
| *B01F 23/2373* | (2022.01) |

(52) U.S. Cl.
CPC ..... *B01F 23/2323* (2022.01); *B01F 23/238* (2022.01); *B01F 23/2366* (2022.01); *B01F 35/93* (2022.01); *B01F 23/2373* (2022.01)

(58) Field of Classification Search
CPC ..... B01F 15/066; B01F 23/2323
See application file for complete search history.

(56) References Cited

U.S. PATENT DOCUMENTS

2013/0042756 A1* 2/2013 Oda ..... B03C 3/47 95/64
2020/0254468 A1 8/2020 Kubota et al.

FOREIGN PATENT DOCUMENTS

JP 2012035353 A * 2/2012
JP 2019-42732 A 3/2019

* cited by examiner

*Primary Examiner* — Robert A Hopkins
(74) *Attorney, Agent, or Firm* — Venable LLP

(57) ABSTRACT

An object of the present disclosure is to improve the generation efficiency of a UFB-contained liquid in a generation apparatus having a circulation mechanism. One embodiment of the present invention is an ultra fine bubble generation apparatus including: a first tank that stores a liquid; a generation unit configured to generate an ultra fine bubble in the liquid output from the first tank; a second tank that stores the liquid output from the generation unit; and a liquid passage that inputs again the liquid stored in the second tank to the first tank, and the ultra fine bubble generation apparatus includes a blocking configuration that blocks an ultra fine bubble included in the stored liquid from being input again to the first tank.

19 Claims, 20 Drawing Sheets

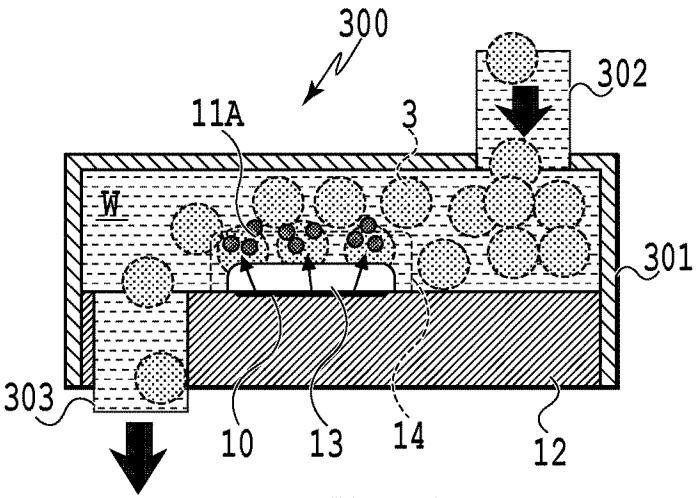
FIG.7A
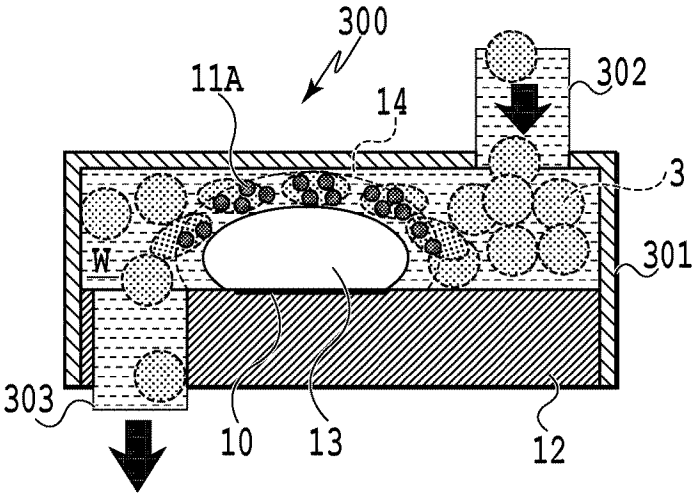
FIG.7B
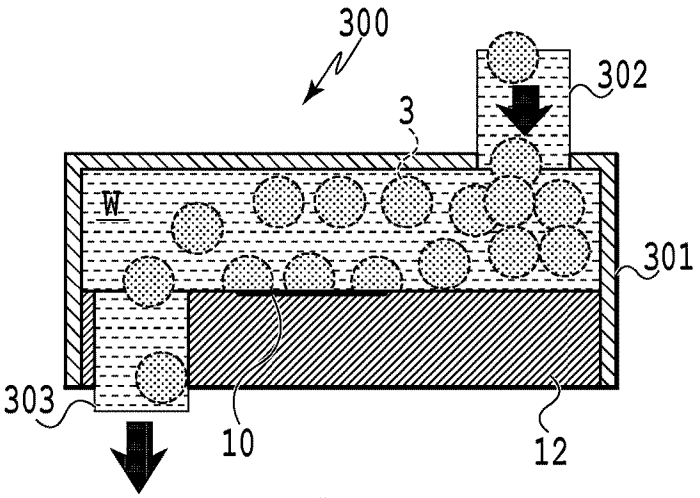
FIG.7C
FIG.7D

ULTRA FINE BUBBLE GENERATION APPARATUS

BACKGROUND OF THE INVENTION

Field of the Invention

The present disclosure relates to an ultra fine bubble generation apparatus that generates an ultra fine bubble whose diameter is less than 1.0 μm.

Description of the Related Art

In recent years, the technique has been developed that applies the characteristic of a fine bubble, such as a micro bubble having a diameter of micrometer size and a nano bubble having a diameter of nanometer size. In particular, the usefulness of an ultra fine bubble having s diameter less than 1.0 μm has been verified in a variety of fields.

Japanese Patent Laid-Open No. 2019-42732 has disclosed efficient generation of a UFB-contained liquid with a high number density by providing a circulation mechanism of the UFB-contained liquid (FIG. 2 and the like in Japanese Patent Laid-Open No. 2019-42732).

SUMMARY OF THE INVENTION

An object of one embodiment of the present invention is to improve the generation efficiency of a UFB-contained liquid in a generation apparatus having a circulation mechanism.

One embodiment of the present invention is an ultra fine bubble generation apparatus including: a first tank that stores a liquid; a generation unit configured to generate an ultra fine bubble in the liquid output from the first tank; a second tank that stores the liquid output from the generation unit; and a liquid passage that inputs again the liquid stored in the second tank to the first tank, and the ultra fine bubble generation apparatus includes a blocking configuration that blocks an ultra fine bubble included in the stored liquid from being input again to the first tank.

Further features of the present invention will become apparent from the following description of exemplary embodiments with reference to the attached drawings.

BRIEF DESCRIPTION OF THE DRAWINGS

FIG. 7A to FIG. 7D are diagrams showing the way a UFB is generated accompanying expansion of a film boiling bubble;

DESCRIPTION OF THE EMBODIMENTS

<<Configuration of UFB Generation Apparatus>>

Figure 1:
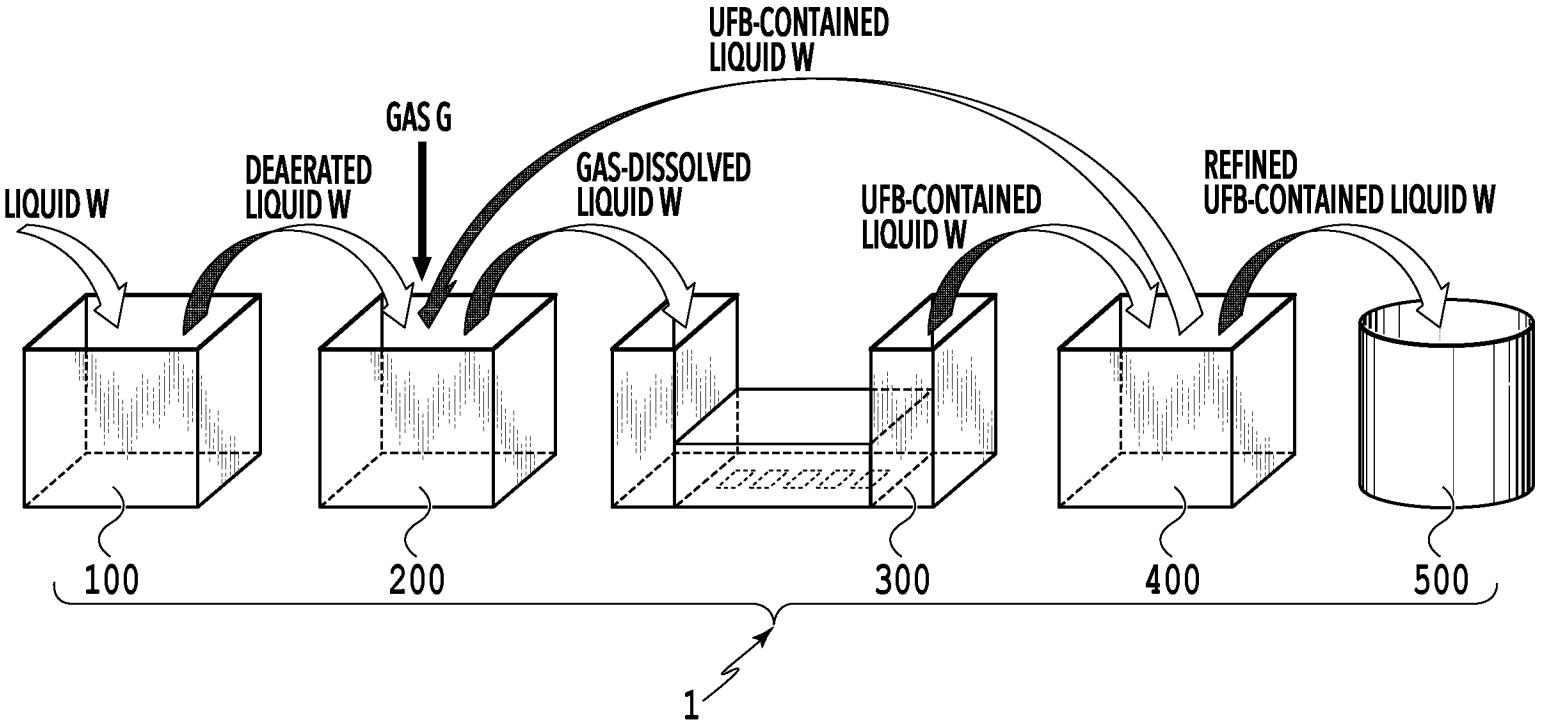
FIG. 1 is a diagram showing an example of a UFB generation apparatus.

FIG. 1 is a diagram showing an example of a UFB generation apparatus that can be applied to the present disclosure. A UFB generation apparatus 1 of the present embodiment includes a preprocessing unit 100, a dissolving unit 200, a T-UFB generation unit 300, a post-processing unit 400, and a collection unit 500. For a liquid W, such as tap water, which is supplied to the preprocessing unit 100, processing unique to each unit is performed in the above-described order and the liquid W is collected by the collection unit 500 as a T-UFB-contained liquid. In the following, the function and configuration of each unit are explained. Although details will be described later, in the present specification, the UFB that is generated by making use of film boiling accompanying sudden heat generation is referred to as T-UFB (Thermal-Ultra Fine Bubble).

Figure 2:
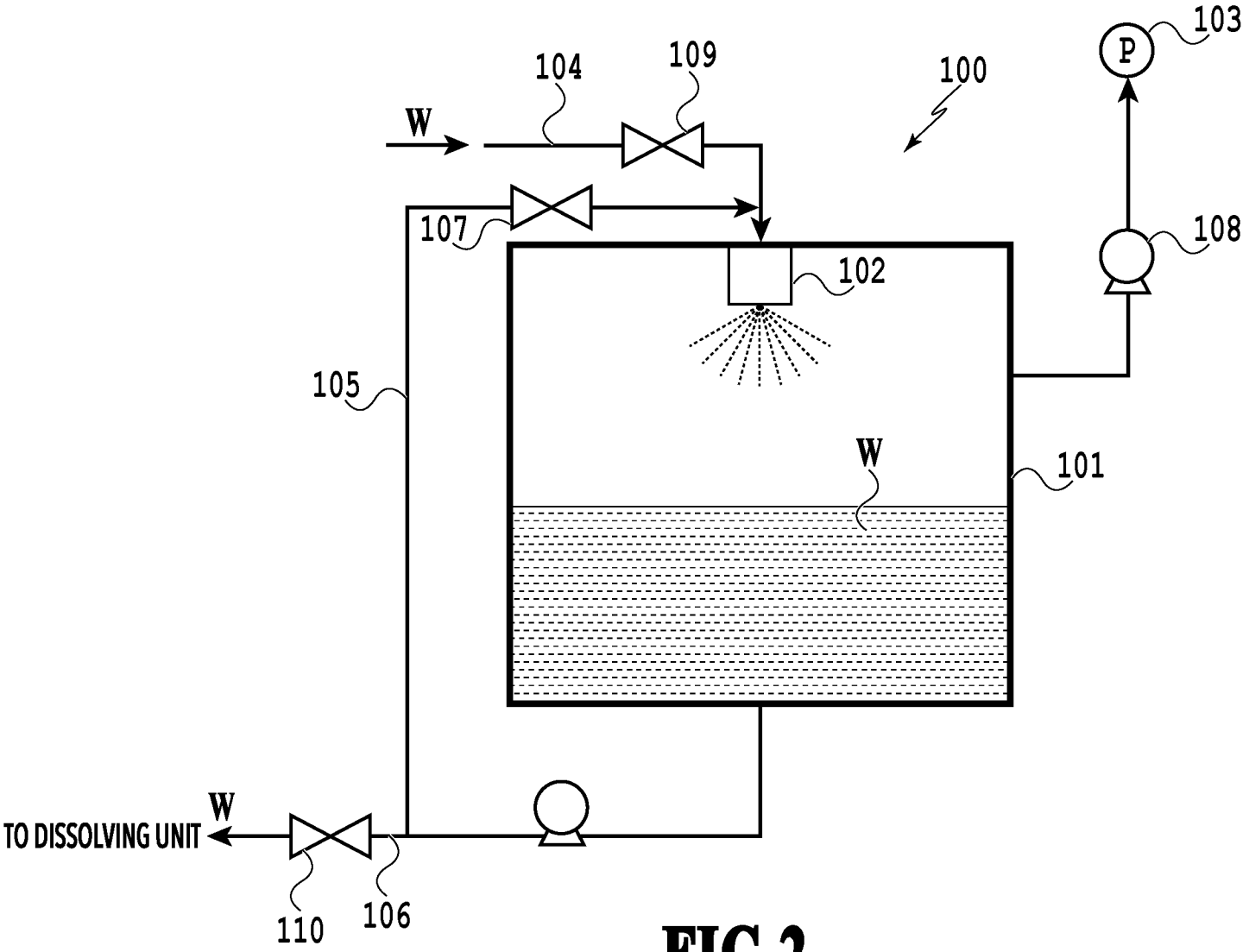
FIG. 2 is a schematic configuration diagram of a preprocessing unit.

FIG. 2 is a schematic configuration diagram of the preprocessing unit 100. The preprocessing unit 100 of the present embodiment performs deaeration processing for the supplied liquid W. The preprocessing unit 100 mainly has a deaeration container 101, a shower head 102, a decompression pump 103, a liquid introduction passage 104, a liquid circulation path 105, and a liquid discharge passage 106. For example, the liquid W, such as tap water, is supplied from the liquid introduction passage 104 to the deaeration container 101 via a valve 109. At this time, the shower head 102 provided in the deaeration container 101 turns the liquid W into fog and sprays the fog within the deaeration container 101. The shower head 102 is for facilitating vaporization of the liquid W, but as a mechanism to produce the vaporization facilitating effect, it is also possible to use a centrifugal machine or the like alternatively.

After a certain amount of the liquid W is stored in the deaeration container 101, in a case where the decompression pump 103 is activated in a state where all the valves are closed, the gas component already vaporized is discharged and at the same time, the vaporization and discharge of the gas component dissolved in the liquid W are also facilitated. At this time, it is sufficient to reduce the internal pressure of the deaeration container 101 to about several hundred to several thousand Pa (1.0 Torr to 10.0 Torr) while checking a pressure gauge 108. The gas that is deaerated by the preprocessing unit 100 includes, for example, nitrogen, oxygen, argon, carbon dioxide and the like.

It is possible to repeatedly perform the deaeration processing explained above for the same liquid W by making use of the liquid circulation path 105. Specifically, in a state where the valve 109 of the liquid introduction passage 104 and a valve 110 of the liquid discharge passage 106 are closed and a valve 107 of the liquid circulation path 105 is opened, the shower head 102 is activated. Due to this, the liquid W stored in the deaeration container 101 and for which the deaeration processing has been performed once is sprayed within the deaeration container 101 again via the shower head 102. Further, by activating the decompression pump 103, the vaporization processing by the shower head 102 and the deaeration processing by the decompression pump 103 are performed repeatedly for the same liquid W. Then, each time the above-described repetition processing making use of the liquid circulation path 105 is performed, it is possible to reduce the gas component included in the liquid W stepwise. In a case where the liquid W deaerated to a predetermined purity is obtained, by opening the valve 110, the liquid W is sent to the dissolving unit 200 via the liquid discharge passage 106.

In FIG. 2, the preprocessing unit 100 that vaporizes a dissolved material by reducing the pressure of a gas including portion is shown, but the method of deaerating a dissolved liquid is not limited to this. For example, it may also be possible to adopt a heating/boiling method of vaporizing a dissolved material by boiling the liquid W, or a film deaeration method of increasing the interface between liquid and gas by using a hollow system. As the deaeration module using a hollow system, the SEPAREL series (made by DIC Corporation) is sold on the market. This is used for the purpose of deaerating an air bubble from ink that is supplied mainly to a piezo head by using poly 4-methylpentene-1 (PMP) as the material of the hollow system. Further, it may also be possible to use two or more of a vacuum deaeration method, the heating/boiling method, and the film deaeration method at the same time.

Figure 3A:
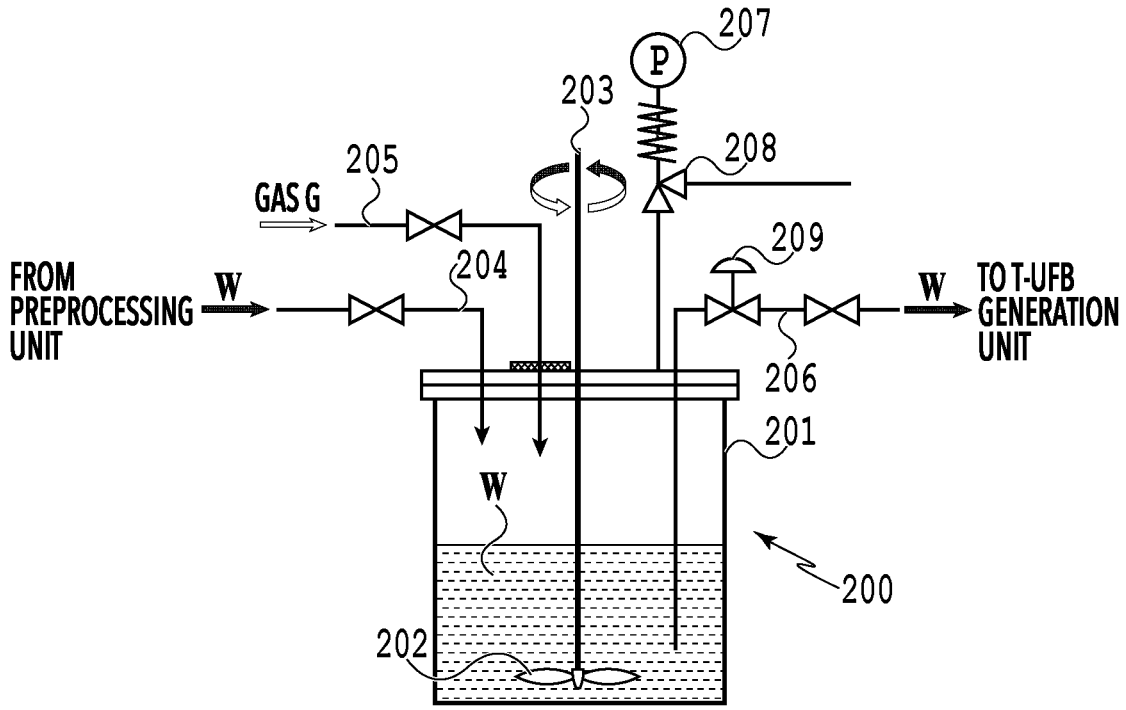
FIG. 3A and FIG. 3B are a schematic configuration diagram of a dissolving unit and a diagram for explaining a dissolving state of a liquid, respectively.
Figure 3B:
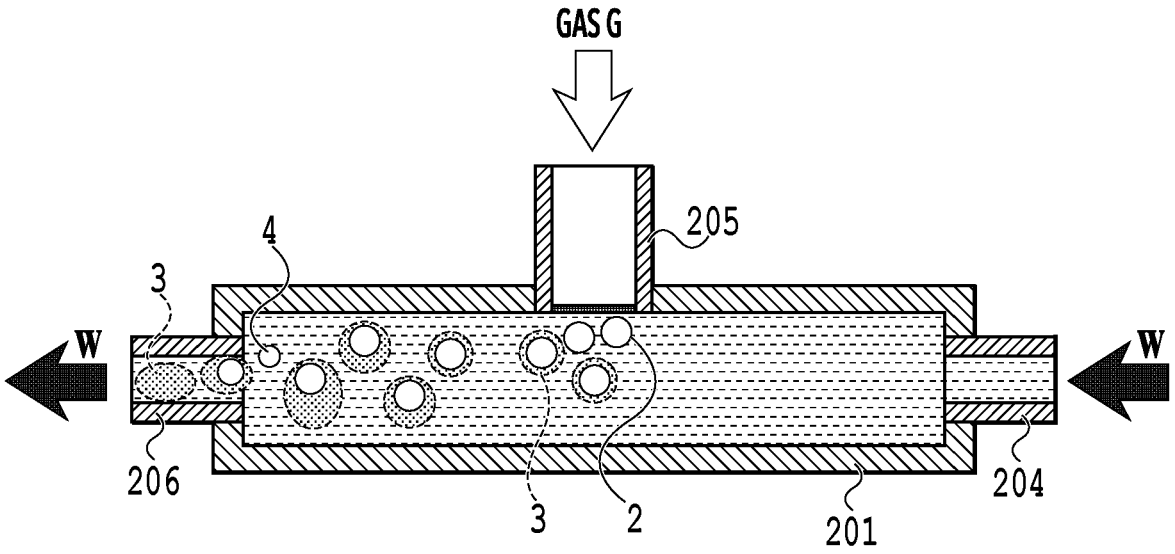

FIG. 3A and FIG. 3B are a schematic configuration diagram of the dissolving unit 200 and a diagram for explaining the dissolving state of a liquid, respectively. The dissolving unit 200 is a unit configured to dissolve a desired gas in the liquid W supplied from the preprocessing unit 100. The dissolving unit 200 of the present embodiment mainly has a dissolving container 201, a rotation shaft 203 to which a rotation plate 202 is attached, a liquid introduction passage 204, a gas introduction passage 205, a liquid discharge passage 206, and a pressure pump 207.

The liquid W supplied from the preprocessing unit 100 is supplied to the dissolving container 201 by the liquid introduction passage 204 and stored therein. On the other hand, a gas G is supplied to the dissolving container 201 by the gas introduction passage 205.

In a case where a predetermined amount of the liquid W and the gas G is stored in the dissolving container 201, the pressure pump 207 is activated and the internal pressure of the dissolving container 201 is increased to about 0.5 MPa. Between the pressure pump 207 and the dissolving container 201, a safety valve 208 is arranged. Further, by rotating the rotation plate 202 in the liquid via the rotation shaft 203, the gas G supplied to the dissolving container 201 is turned into an air bubble and dissolving into the liquid W is facilitated by increasing the contact area with the liquid W. Then, the work such as this is continued until the solubility of the gas G reaches substantially the maximum saturated solubility. At this time, in order to dissolve the gas as much as possible, it may also be possible to arrange a unit to reduce the temperature of the liquid. Further, in a case of an insoluble gas, it is also possible to increase the internal pressure of the dissolving container 201 to 0.5 MPa or higher. In that case, it is necessary to make optimum the material and the like of the container in view of safety.

In a case where the liquid Win which the component of the gas G is dissolved in a desired concentration is obtained, the liquid W is discharged via the liquid discharge passage 206 and supplied to the T-UFB generation unit 300. At this time, a back pressure valve 209 adjusts the flow pressure of the liquid W so that the pressure at the time of supply becomes higher than necessary.

FIG. 3B is a diagram schematically showing the way the gas G mixed in the dissolving container 201 is dissolved. An air bubble 2 including the component of the gas G mixed in the liquid W dissolves from the portion in touch with the liquid W. Because of this, the air bubble 2 gradually contracts and a state is brought about where a gas-dissolved liquid 3 exists around the air bubble 2. The buoyant force acts on the air bubble 2, and therefore, the air bubble 2 moves to a position a deviated from the center of the gas-dissolved liquid 3, separates from the gas-dissolved liquid 3 and becomes a remaining air bubble 4, and so on. That is, in the liquid W that is supplied to the T-UFB generation unit 300 via the liquid discharge passage 206, a state where the air bubble 2 is surrounded by the gas-dissolved liquid 3 and a state where the gas-dissolved liquid 3 and the air bubble 2 are separate from each other exist in a mixed manner.

In FIG. 3B, the gas-dissolved liquid 3 means "an area in which the solubility concentration of the mixed gas G is comparatively high in the liquid W". For the gas component actually dissolved in the liquid W, the concentration is the highest at the center of the area even in the state of being located around the air bubble 2 or of being separate from the air bubble 2 and as the gas component becomes more distant from the position, the concentration of the gas component becomes low continuously. That is, in FIG. 3B, the area of the gas-dissolved liquid 3 is surrounded by a broken line for explanation, but in actuality, the clear boundary such as this does not exist. Further, in the present disclosure, it is permitted that the gas that does not dissolve completely exists in the liquid in a state of an air bubble.

Figure 4:
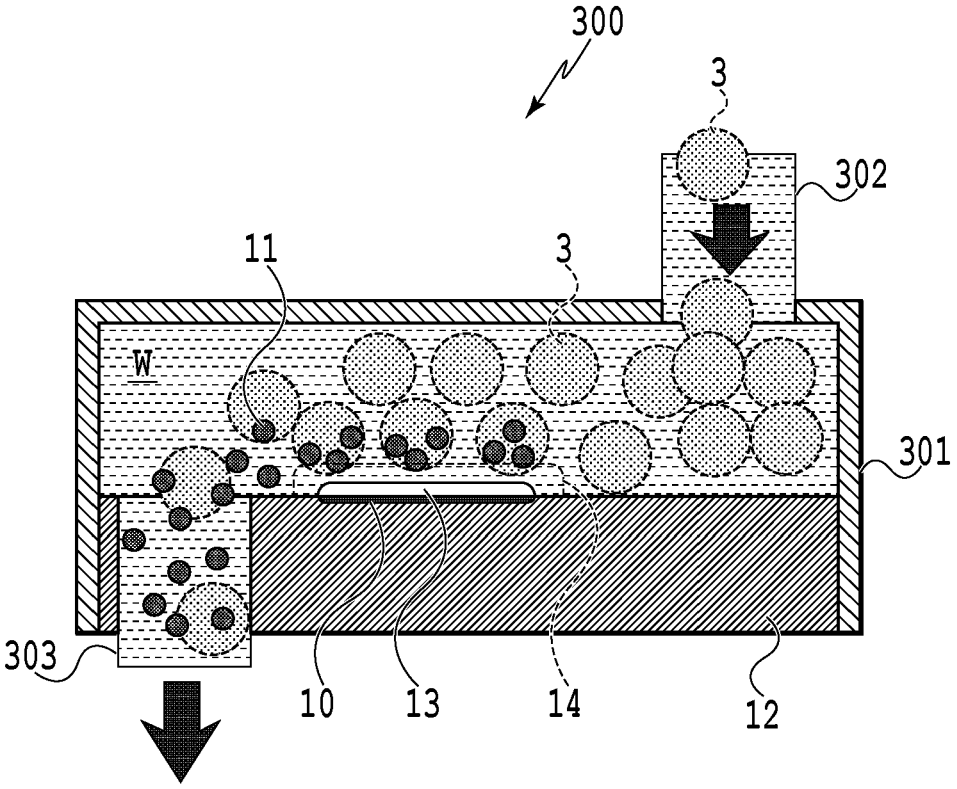
FIG. 4 is a schematic configuration diagram of a T-UFB generation unit.

FIG. 4 is a schematic configuration diagram of the T-UFB generation unit 300. The T-UFB generation unit 300 mainly comprises a chamber 301, a liquid introduction passage 302, and a liquid discharge passage 303 and a flow from the liquid introduction passage 302 toward the liquid discharge passage 303 through the inside of the chamber 301 is formed by a flow pump, not shown schematically. As the flow pump, it is possible to adopt various pumps, such as a diaphragm pump, a gear pump, and a screw pump. In the liquid W that is introduced from the liquid introduction passage 302, the gas-dissolved liquid 3 of the gas G mixed by the dissolving unit 200 exists in a mixed manner.

At the bottom surface of the chamber 301, an element substrate 12 on which a heating element 10 is provided is arranged. By applying a predetermined voltage pulse to the heating element 10, a bubble 13 (in the following, also referred to as film boiling bubble 13) generated by film boiling occurs in the area that comes into contact with the heating element 10. Then, an ultra fine bubble (UFB 11) containing the gas G is generated accompanying expansion and contraction of the film boiling bubble 13. As a result of that, from the liquid discharge passage 303, the UFB-contained liquid W in which the many UFBs 11 are included is discharged.

Figure 5A:
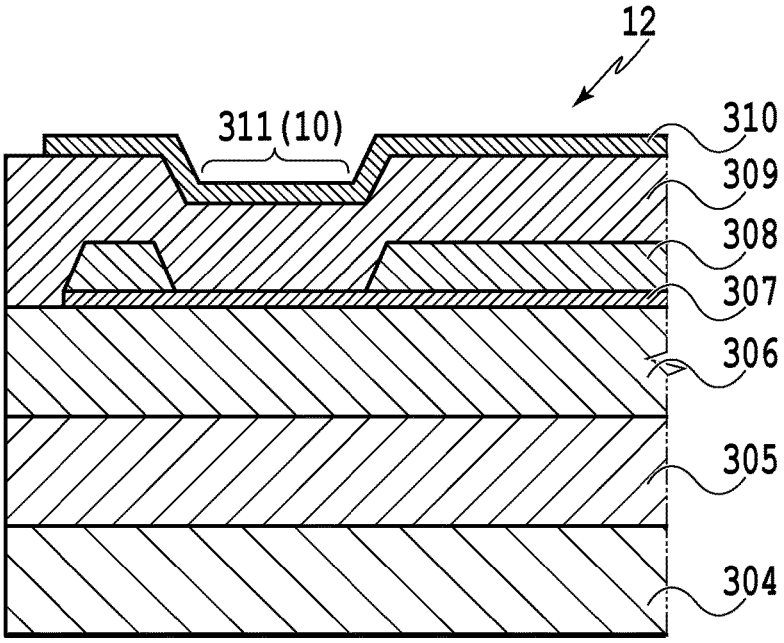
FIG. 5A and FIG. 5B are each a diagram for explaining details of a heating element.
Figure 5B:
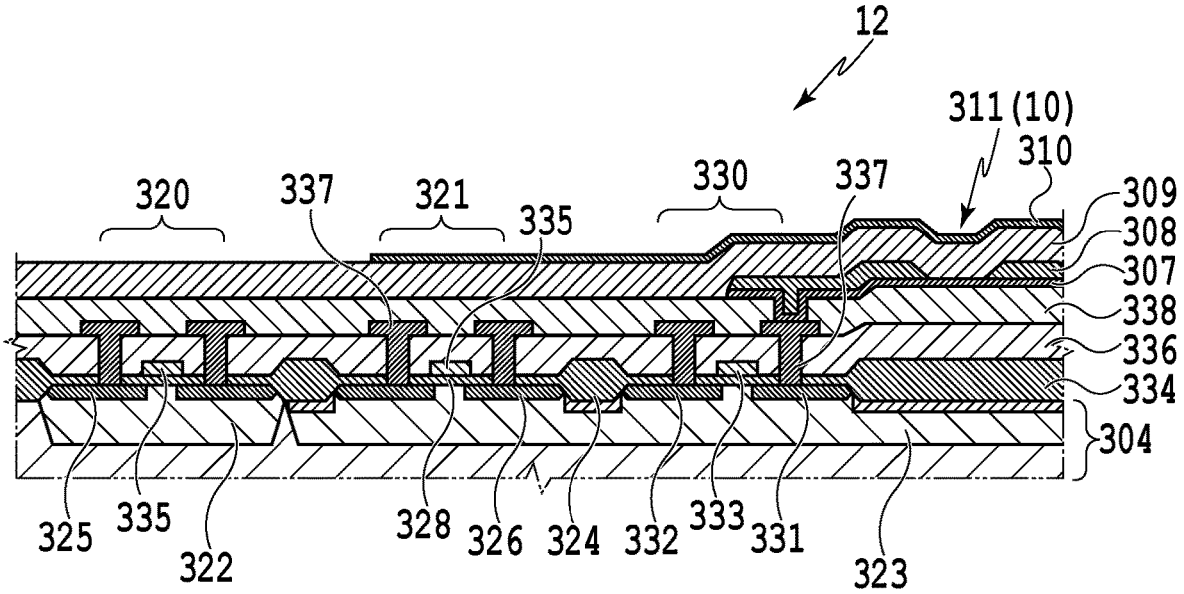

FIG. 5A and FIG. 5B are each a diagram showing a detailed structure of the heating element 10. FIG. 5A shows a cross-sectional diagram of the vicinity of the heating element 10 and FIG. 5B shows a cross-sectional diagram of the element substrate 12 in a wider area including the heating element 10, respectively.

As shown in FIG. 5A, in the element substrate 12 of the present embodiment, on the front surface of a silicon substrate 304, a thermal oxide film 305, as a heat storage layer, and an interlaminar film 306, which also functions as a heat storage layer, are laminated. As the interlaminar film 306, it is possible to use a $SiO_2$ film or a SiN film. On the front surface of the interlaminar film 306, a resistant layer 307 is formed and on the front surface of the resistant layer 307, a wire 308 is formed partially. As the wire 308, it is possible to use an Al alloy wire of Al, Al—Si, Al—Cu or the like. On the front surfaces of the wire 308, the resistant layer 307, and the interlaminar film 306, a protective layer 309 including a $SiO_2$ film or a $Si_3N_4$ film is formed.

On the front surface of the protective layer 309, at the portion corresponding to a heat acting portion 311, which eventually functions as the heating element 10, and on the periphery thereof, an anti-cavitation film 310 for protecting the protective layer 309 from the chemical and physical impacts accompanying heat generation of the resistant layer 307 is formed. On the front surface of the resistant layer 307, the area in which the wire 308 is not formed is the heat acting portion 311 at which the resistant layer 307 generates heat. The heat generation portion of the resistant layer 307 at which the wire 308 is not formed functions as the heating element (heater) 10. The layers in the element substrate 12 are formed sequentially on the front surface of the silicon substrate 304 by the semiconductor manufacturing technique and due to this, the silicon substrate 304 is provided with the heat acting portion 311.

The configuration shown in FIG. 5A is an example and it is possible to apply other various configurations. For example, it is possible to apply a configuration in which the lamination order of the resistant layer 307 and the wire 308 is opposite and a configuration (so-called plug electrode configuration) in which an electrode is connected to the lower surface of the resistant layer 307. That is, as will be described later, the configuration is only required to be one in which it is possible to cause film boiling to take place in a liquid by heating the liquid by the heat acting portion 311.

FIG. 5B is an example of the cross-sectional diagram of the area including the circuit that is connected to the wire 308 in the element substrate 12. On the front layer of the silicon substrate 304, which is a P-type electric conductor, an N-type well area 322 and a P-type well area 323 are provided partially. By introduction and diffusion of impurities, such as ion implantation by a general MOS process, a P-MOS 320 is formed in the N-type well area 322 and an N-MOS 321 is formed in the P-type well area 323.

The P-MOS 320 includes a source area 325 and a drain area 326 formed by introducing N-type or P-type impurities partially into the front layer of the N-type well area 322, a gate wire 335 and the like. The gate wire 335 is deposited via a gate insulation film 328 having a thickness of several hundred Å on the front surface of the portion of the N-type well area 322 except for the source area 325 and the drain area 326.

The N-MOS 321 includes the source area 325 and the drain area 326 formed by introducing N-type or P-type impurities partially into the front layer of the P-type well area 323, the gate wire 335 and the like. The gate wire 335 is deposited via the gate insulation film 328 having a thickness of several hundred Å on the front surface of the portion of the P-type well area 323 except for the source area 325 and the drain area 326. The gate wire 335 includes polysilicon having a thickness of 3,000 Å to 5,000 Å deposited by the CVD method. By the P-MOS 320 and the N-MOS 321, a C-MOS logic is configured.

In the P-type well area 323, at the portion different from the N-MOS 321, an N-MOS transistor 330 for driving an electrothermal conversion element (heating resistance element) is formed. The N-MOS transistor 330 includes a source area 332 and a drain area 331 formed partially on the front layer of the P-type well area 323 by the process, such as introduction and diffusion of impurities, a gate wire 333 and the like. The gate wire 333 is deposited via the gate insulating film 328 on the front surface of the portion except for the source area 332 and the drain area 331 in the P-type well area 323.

In this example, as the transistor for driving the electrothermal conversion element, the N-MOS transistor 330 is used. However, the driving transistor may be any transistor having the capacity to individually drive a plurality of electrothermal conversion elements and capable of obtaining the fine structure as described above and is not limited to the N-MOS transistor 330. Further, in this example, the electrothermal conversion element and the driving transistor thereof are formed on the same substrate, but it may also be possible to form these on separate substrates.

Between each element, such as between the P-MOS 320 and the N-MOS 321 and between the N-MOS 321 and the N-MOS transistor 330, an oxide film separation area 324 having a thickness of 5,000 Å to 10,000 Å is formed by filed oxidation. By this oxide film separation area 324, each element is separated. In the oxide film separation area 324, the portion corresponding to the heat acting portion 311 functions as a first heat storage layer 324 on the silicon substrate 304.

On the front surface of each element of the P-MOS 320, the N-MOS 321, and the N-MOS transistor 330, an interlayer insulating film 336 including a PSG film having a thickness of about 7,000 Å, a BPSG film or the like is formed by the CVD method. After flattening the interlayer insulating film 336 by heat processing, an Al electrode 337 that becomes a first wire layer is formed via a contact hole penetrating through the interlayer insulating film 336 and the gate insulating film 328. On the front surfaces of the interlayer insulating film 336 and the Al electrode 337, an interlayer insulating film 338 including a $SiO_2$ film having a thickness of 10,000 Å to 15,000 Å is formed by the plasma CVD method. On the front surface of the interlayer insulating film 338, at the portion corresponding to the heat acting portion 311 and the N-MOS transistor 330, the resistant layer 307 including a TaSiN film having a thickness of about 500 Å is formed by the cosputter method. The resistant layer 307 is electrically connected with the Al electrode 337 in the vicinity of the drain area 331 via a through hole formed in the interlayer insulating film 338. On the surface of the resistant layer 307, the Al wire 308 as s second wire layer that becomes a wire to each electrothermal conversion element is formed. The protective layer 309 on the front surfaces of the wire 308, the resistant layer 307, and the interlayer insulating film 338 includes a SiN film having a thickness of 3,000 Å formed by the plasma CVD method. The anti-cavitation film 310 deposited on the front surface of the protective layer 309 is at least one or more metals selected from Ta, Fe, Ni, Cr, Ge, Ru, Zr, Ir and the like and includes a thin film having a thickness of about 2,000 Å. As the resistant layer 307, it is possible to apply various materials capable of causing film boiling to take place in a liquid, such as TaN0.8, CrSiN, TaAl, WSiN and the like other than TaSi described above.

Figure 6A:
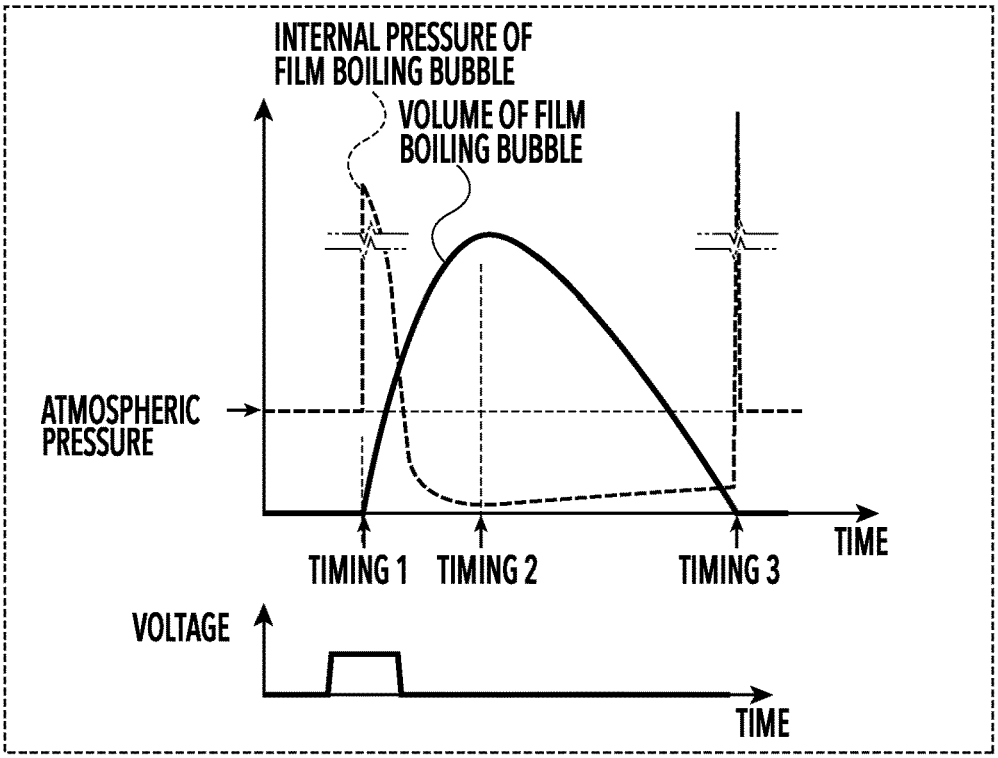
FIG. 6A and FIG. 6B are each a diagram for explaining the state of film boiling in the heating element.
Figure 6B:
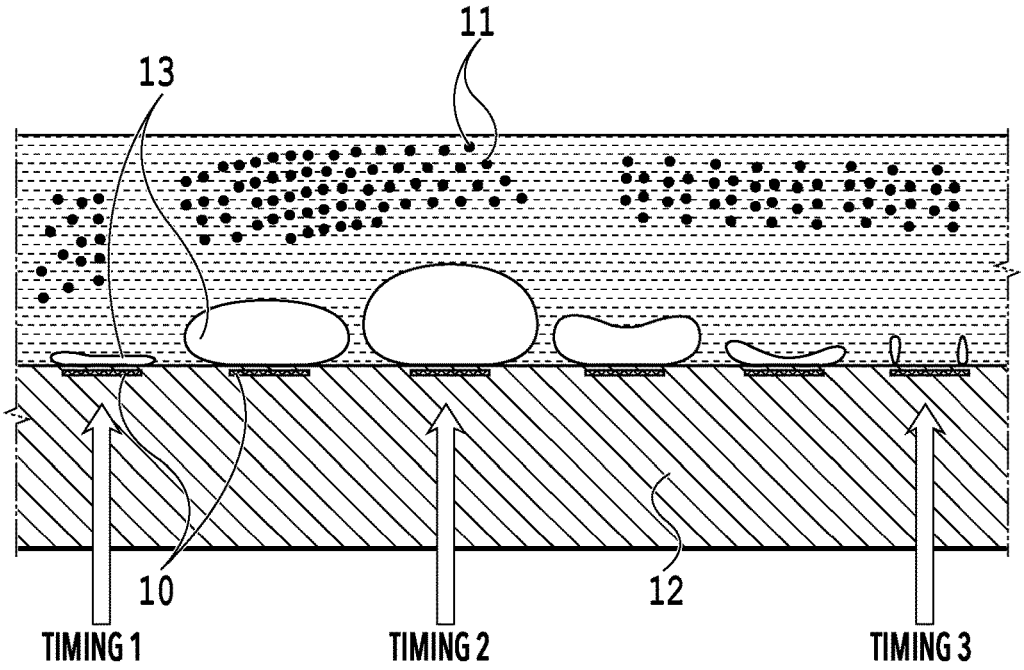

FIG. 6A and FIG. 6B are each a diagram showing the state of film boiling in a case where a predetermined voltage pulse is applied to the heating element 10. Here, a case where film boiling is caused to take place under the atmospheric pressure is shown. In FIG. 6A, the horizontal axis represents time. Further, the vertical axis of the graph at the lower portion represents the voltage that is applied to the heating element 10 and the vertical axis of the graph at the upper portion represents the volume and the internal pressure of the film boiling bubble 13 that occurs by film boiling. On the other hand, FIG. 6B shows the state of the film boiling bubble 13 in association with timing 1 to timing 3 shown in FIG. 6A. In the following, each state is explained along time. As will be described later, the UFB 11 that occurs by film boiling occurs mainly in the vicinity of the front surface of the film boiling bubble 13. The state shown in FIG. 6B shows, as shown in FIG. 1, the state where the liquid including the UFB 11 that has occurred in the generation unit 300 is supplied again to the dissolving unit 200 via the circulation path and the liquid is supplied again to the liquid passage of the generation unit 300.

Before a voltage is applied to the heating element 10, substantially the atmospheric pressure is kept within the chamber 301. In a case where a voltage is applied to the heating element 10, film boiling takes place in the liquid in contact with the heating element 10 and the air bubble (in the following, referred to as film boiling bubble 13) having occurred expands by a high pressure that acts from the inside (timing 1). The foaming pressure at this time is regarded as about 8 to 10 MPa and this is close to the value of the saturated vapor pressure of water.

The voltage application time (pulse width) is about 0.5 μsec to 10.0 μsec, but after the voltage is no longer applied, the film boiling bubble 13 expands by the inertia of the pressure obtained at timing 1. However, inside the film boiling bubble 13, the negative pressure force having occurred accompanying the expansion gradually becomes large and acts in the direction in which the film boiling bubble 13 contracts. Then, after a while, at timing 2 at which the inertial force and the negative pressure force become in equilibrium, the volume of the film boiling bubble 13 reaches the maximum and after that, the film boiling bubble 13 contracts rapidly by the negative pressure force.

At the time of the film boiling bubble 13 becoming extinct, the film boiling bubble 13 does not become extinct at the entire surface of the heating element 10 but becomes extinct in a very small area at one or more portions. Because of this, in the heating element 10, in the very small area in which the film boiling bubble 13 becomes extinct, a force larger than that at the time of foaming indicated by timing 1 occurs (timing 3).

The occurrence, expansion, contraction, and extinction of the film boiling bubble 13 as explained above are repeated each time the voltage pulse is applied to the heating element 10 and the new UFB 11 is generated each time.

Next, by using FIG. 7A to FIG. 10B, the way the UFB 11 is generated in each process of the occurrence, expansion, contraction, and extinction of the film boiling bubble 13 is explained in more detail.

FIG. 7A to FIG. 7D are diagrams schematically showing the way the UFB 11 is generated accompanying the occurrence and expansion of the film boiling bubble 13. FIG. 7A shows the state before the voltage pulse is applied to the heating element 10. Inside the chamber 301, the liquid W in which the gas-dissolved liquid 3 exists in a mixed manner flows.

FIG. 7B shows the way the voltage is applied to the heating element 10 and the film boiling bubble 13 has occurred uniformly in almost all areas of the heating element 10 in contact with the liquid W. In a case where the voltage is applied, the surface temperature of the heating element 10 rises rapidly at a speed higher than or equal to 10° C./μsec and at the point in time at which about 300° C. is reached, film boiling takes place and the film boiling bubble 13 is generated.

The surface temperature of the heating element 10 rises up to about 600 to 800° C. during the application of the pulse after that and the liquid on the periphery of the film boiling bubble 13 is also heated rapidly. In FIG. 7B, the area of the liquid that is located on the periphery of the film boiling bubble 13 and which is heated rapidly is shown as an un-foamed high-temperature area 14. The gas-dissolved liquid 3 included in the un-foamed high-temperature area 14 exceeds the thermal solubility limit and precipitates to become the UFB. The diameter of the precipitated air bubble is about 10 nm to 100 nm and has a high air-liquid interface energy. Because of this, the air bubble does not become extinct in a short time and floats while keeping independence within the liquid W. In the present embodiment, the air bubble that is generated by the thermal action during the period from the occurrence of the film boiling bubble 13 until the expansion in this manner is referred to as a first UFB 11A.

FIG. 7C shows the process in which the film boiling bubble 13 expands. Even though the application of the voltage pulse to the heating element 10 is terminated, the film boiling bubble 13 continues to expand by the inertia of the force obtained at the time of occurrence and the un-foamed high-temperature area 14 also moves and diffuses by the inertia. That is, in the process in which the film boiling bubble 13 expands, the gas-dissolved liquid 3 included in the un-foamed high-temperature area 14 becomes an air bubble anew and precipitates to become the first UFB 11A.

FIG. 7D shows the state where the volume of film boiling bubble 13 has reached the maximum. The film boiling bubble 13 expands by the inertia, but the negative pressure inside the film boiling bubble 13 gradually increases accompanying the expansion and acts as the negative pressure force that tries to contract the film boiling bubble 13. Then, at the point in time at which this negative pressure force and the inertial force become in equilibrium, the volume of the film boiling bubble 13 reaches the maximum and after that, the film boiling bubble 13 begins to contract.

Figure 8A:
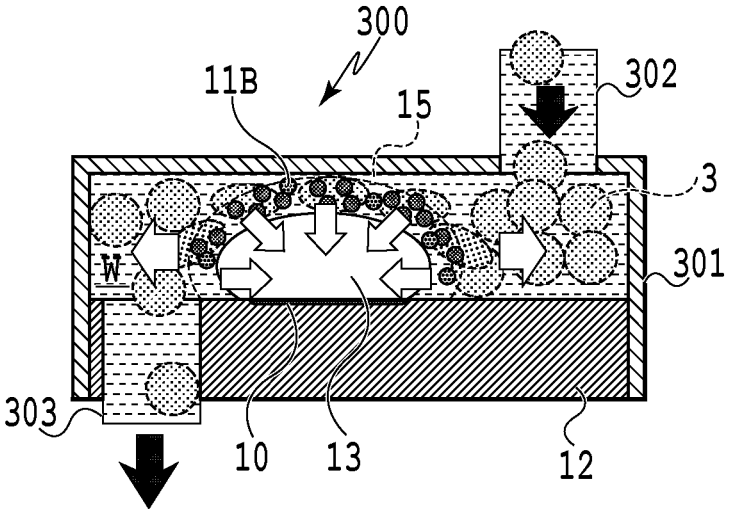
FIG. 8A to FIG. 8C are diagrams showing the way the UFB is generated accompanying contraction of the film boiling bubble.
Figure 8B:
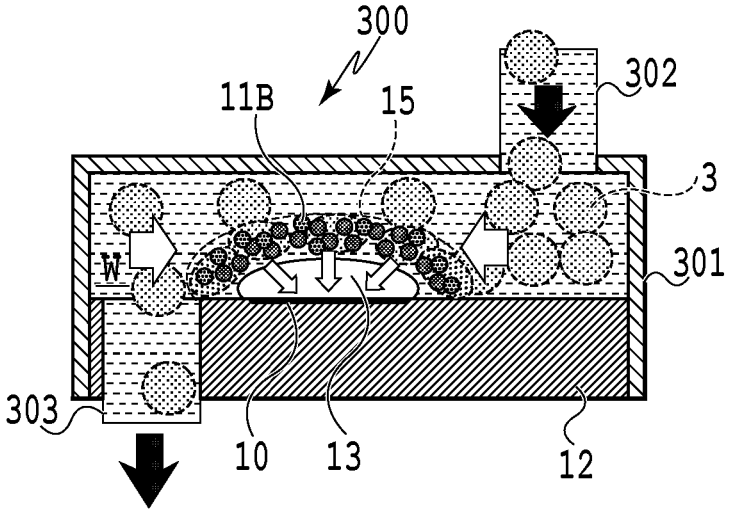
Figure 8C:
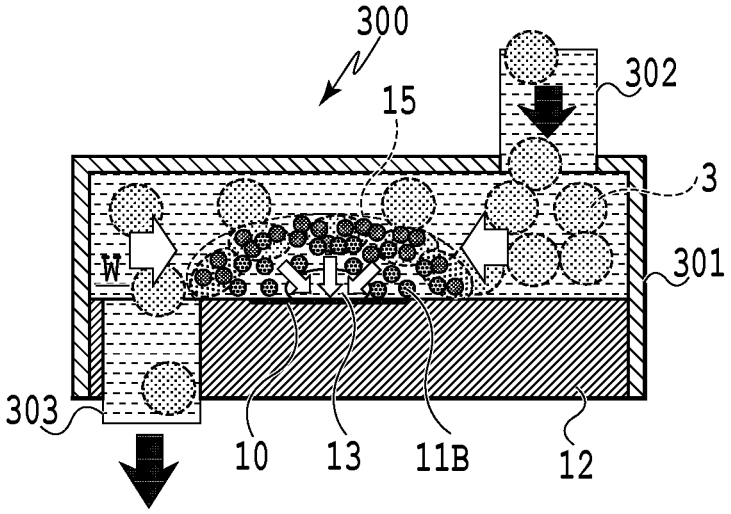
Figure 9A:
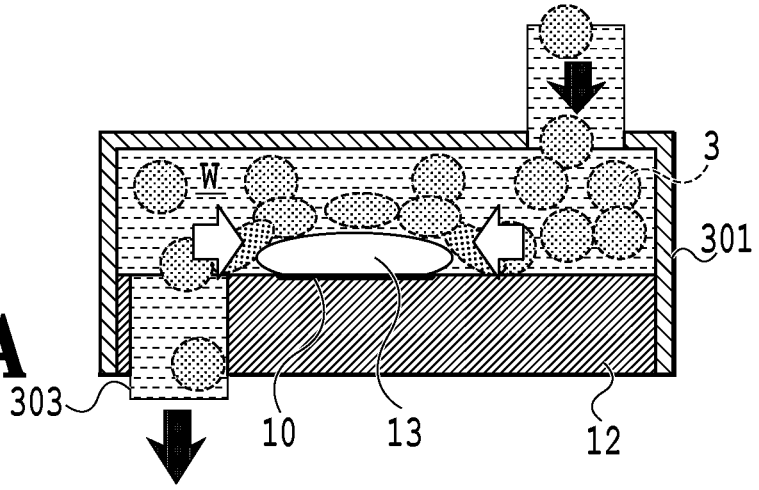
FIG. 9A to FIG. 9C are diagrams showing the way the UFB is generated by reheating of a liquid.
Figure 9B:
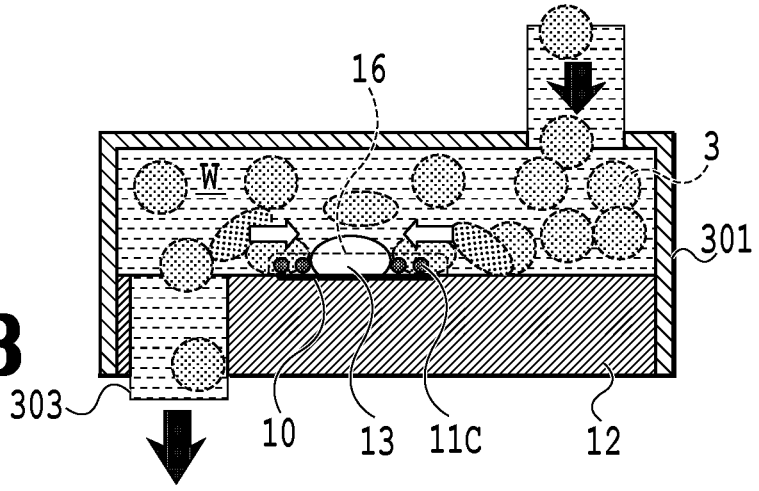
Figure 9C:
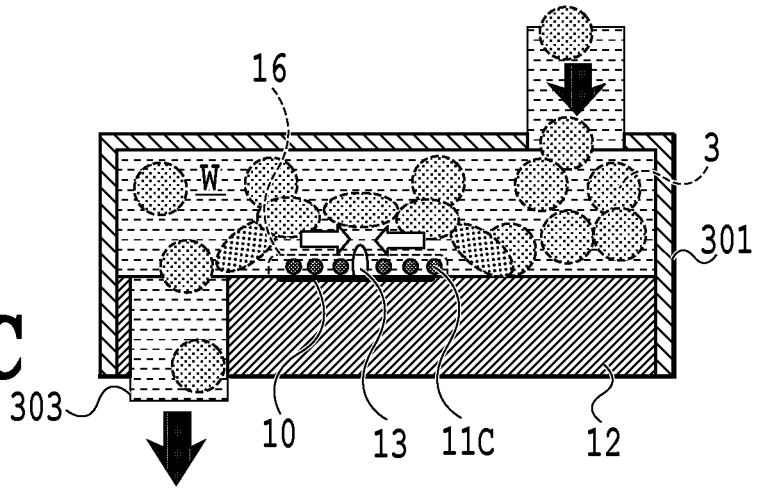

In the contraction stage of the film boiling bubble 13, there are a UFB (second UFB 11B) that occurs in the processes shown in FIG. 8A to FIG. 8C and a UFB (third UFB 11C) that occurs in the processes shown in FIG. 9A to FIG. 9C. It is considered that these two processes occur concurrently.

FIG. 8A to FIG. 8C are diagrams showing the way the UFB 11 is generated accompanying the contraction of the film boiling bubble 13. FIG. 8A shows the state where the film boiling bubble 13 has begun to contract. Even though the film boiling bubble 13 has begun to contract, the inertial force in the direction of expansion remains in the liquid W on the periphery. Consequently, on the close periphery of the film boiling bubble 13, the inertial force that acts in the direction of becoming distant from the heating element 10 and the force in the direction of becoming close to the heating element 10 accompanying the contraction of the film boiling bubble 13 act and the area becomes the depressurized area. In FIG. 8A, the area such as this is shown as an un-foamed negative pressure area 15.

The gas-dissolved liquid 3 included in the un-foamed negative pressure area 15 exceeds the pressure solubility limit and precipitates as an air bubble. The diameter of the precipitated air bubble is about 100 nm and does not become extinct in a short time after that and floats while keeping independence within the liquid W. In the present embodiment, the air bubble that precipitates in this manner by the pressure action at the time of contraction of the film boiling bubble 13 is referred to as the second UFB 11B.

FIG. 8B shows the process in which the film boiling bubble 13 contracts. The speed at which the film boiling bubble 13 contracts is increased by the negative pressure force and the un-foamed negative pressure area 15 also moves accompanying the contraction of the film boiling bubble 13. That is, in the process in which the film boiling bubble 13 contracts, the gas-dissolved liquid 3 at the portion passed by the un-foamed negative pressure area 15 precipitates one after one and becomes the second UFB 11B.

FIG. 8C shows the state immediately before the film boiling bubble 13 becomes extinct. By the accelerating contraction of the film boiling bubble 13, the moving speed of the liquid W on the periphery increases, but the pressure loss occurs due to the flow path resistance within the chamber 301. As a result of that, the area occupied by the un-foamed negative pressure area 15 becomes further large and the many second UFBs 11B are generated.

FIG. 9A to FIG. 9C are diagrams showing the way the UFB is generated by reheating of the liquid W at the time of contraction of the film boiling bubble 13. FIG. 9A shows the state where the front surface of the heating element 10 is covered by the film boiling bubble 13 that contracts.

FIG. 9B shows the state where the contraction of the film boiling bubble 13 advances and a part of the front surface of the heating element 10 is in contact with the liquid W. On the front surface of the heating element 10 at this time, heat remains, whose amount does not cause film boiling to take place even in a case where the liquid W comes into contact with the front surface. In FIG. 9B, the area of the liquid that is heated in a case of coming into contact with the front surface of the heating element 10 is shown as an un-foamed reheating area 16. Although film boiling is not caused to take place, the gas-dissolved liquid 3 included in the un-foamed reheating area 16 exceeds the thermal solubility limit and precipitates. In the present embodiment, the air bubble that is generated in this manner by reheating of the liquid W at the time of contraction of the film boiling bubble 13 is referred to as the third UFB 11C.

FIG. 9C shows the state where the contraction of the film boiling bubble 13 has further advanced. The smaller the film boiling bubble 13 becomes, the larger the area of the heating element 10 that comes into contact with the liquid W becomes, and therefore, the third UFB 11C is generated until the film boiling bubble 13 becomes extinct.

Figure 10A:
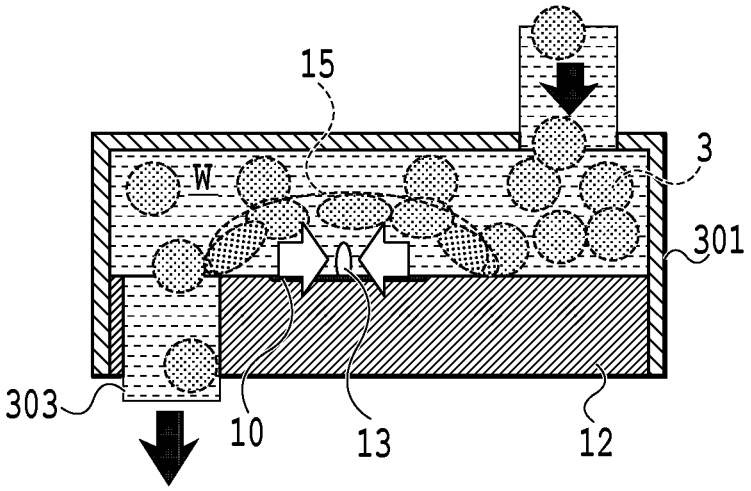
FIG. 10A and FIG. 10B are diagrams showing the way the UFB is generated by an impact wave at the time of disappearance of a bubble generated by film boiling.
Figure 10B:
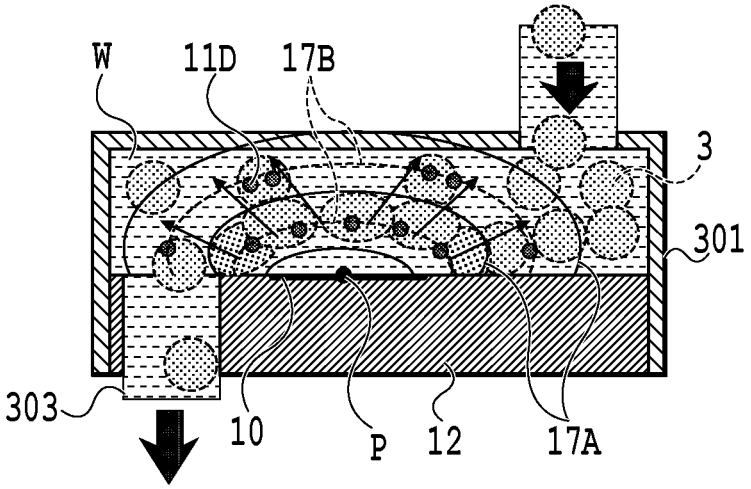

FIG. 10A and FIG. 10B are diagrams showing the way the UFB is generated by an impact (a kind of so-called cavitation) at the time of disappearance of the film boiling bubble 13 generated by film boiling. FIG. 10A shows the state immediately before the film boiling bubble 13 becomes extinct. The film boiling bubble 13 contracts rapidly by the internal negative pressure force and the state is such that the un-foamed negative pressure area 15 covers the periphery of the film boiling bubble 13.

FIG. 10B shows the state immediately after the film boiling bubble 13 has become extinct at a point P. At the time of disappearance of the film boiling bubble 13, an acoustic wave spreads concentrically by the impact with the point P as a start point. The acoustic wave is the general term of the elastic wave that propagates irrespective of gas, liquid, and solid and in the present embodiment, the non-uniformity of the liquid W, that is, a high-pressure surface 17A and a low-pressure surface 17B of the liquid W propagate alternately.

In this case, the gas-dissolved liquid 3 included in the un-foamed negative pressure area 15 is resonated by the impact wave at the time of disappearance of the film boiling bubble 13 and at the timing at which the low-pressure surface 17B passes, the gas-dissolved liquid 3 exceeds the pressure solubility limit and makes a phase transition. That is, at the same time as the extinction of the film boiling bubble 13, many air bubbles precipitate within the un-foamed negative pressure area 15. In the present embodiment, the air bubble such as this, which is generated by the impact wave at the time of disappearance of the film boiling bubble 13, is referred to as a fourth UFB 11D.

The fourth UFB 11D that is generated by the impact wave at the time of disappearance of the film boiling bubble 13 appears suddenly in a very short time (less than or equal to 1 μS) in a very narrow thin film area. The diameter is sufficiently smaller than those of the first to third UFBs and the air-liquid interface energy is larger than those of the first to third UFBs. Because of this, it is considered that the fourth UFB 11D has a characteristic different from those of the first UFB 11A to the third UFB 11C and produces a different effect.

Further, the fourth UFB 11D occurs uniformly at many portions in the concentric sphere-shaped area in which the impact wave propagates, and therefore, the fourth UFB 11D exists uniformly within the chamber 301 from the time in point of generation. At the timing at which the fourth UFB 11D is generated, the many first to third UFBs already exist, but it is unlikely that the existence of these first to third UFBs largely affects the generation of the fourth UFB 11D. Further, it is also considered that the occurrence of the fourth UFB 11D does not cause the first to third UFBs to become extinct.

Figure 11A:
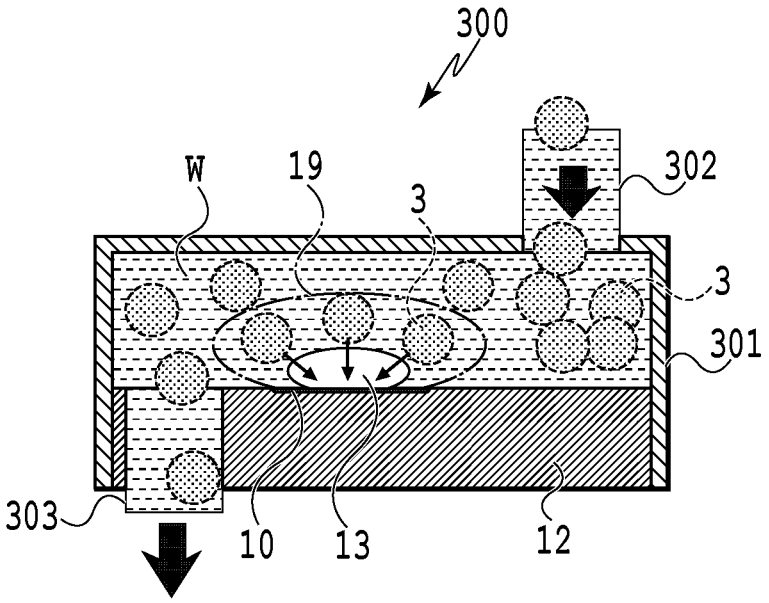
FIG. 11A and FIG. 11B are diagrams showing the way the UFB is generated by a change in saturated solubility of a liquid.
Figure 11B:
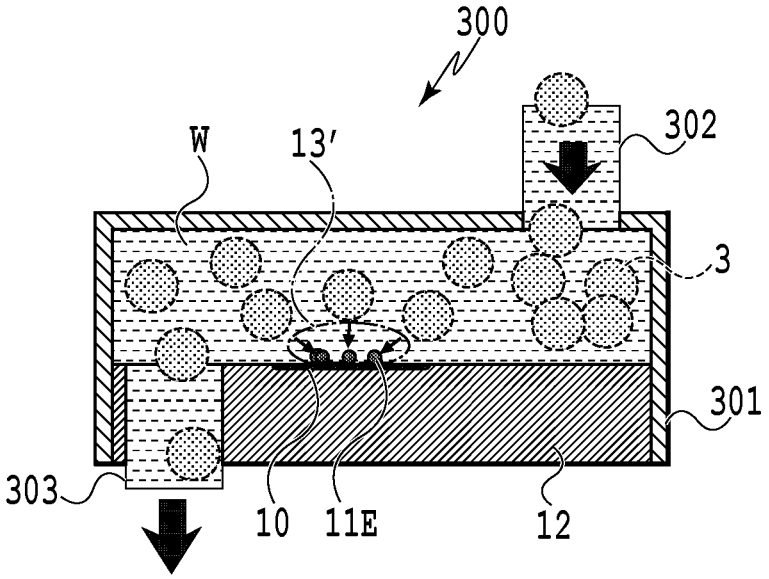

FIG. 11A and FIG. 11B are diagrams showing the way the UFB is generated by the change in the saturated solubility of the liquid W. FIG. 11A shows the state where the film boiling bubble 13 has been generated. Accompanying the generation of the film boiling bubble 13, the liquid W on its periphery is also heated and on the periphery of the film boiling bubble 13, a high-temperature area 19 whose temperature is higher than that of the other area is formed. The higher the temperature of the liquid, the lower the saturated solubility of the liquid W is, and therefore, the saturated solubility of the high-temperature area 19 becomes lower than that of the other area and the supersaturated sate where a phase transition into gas is likely to occur is brought about. Then, the gas-dissolved liquid 3 in the supersaturated state such as this makes a phase transition by coming into contact with the film boiling bubble 13 and precipitates as the UFB. In FIG. 11A, the arrow indicates the direction in which the gas-dissolved liquid 3 precipitates. In the present embodiment, the air bubble that is generated in this manner by the change in the saturated solubility on the periphery of the film boiling bubble 13 is referred to as a fifth UFB 11E.

FIG. 11B shows the state where the film boiling bubble 13 has disappeared. The fifth UFB 11E that is generated by coming into contact with the film boiling bubble 13 is pulled toward the direction of the heating element 10 at the same time as the disappearance of the film boiling bubble 13 and an area 13' having been occupied by the film boiling bubble 13 is filled with the liquid W. The precipitated UFB that is not dissolved again in the liquid W remains as the fifth UFB 11E.

As explained above, it is supposed that the FUB 11 occurs in the plurality of stages from the occurrence of the film boiling bubble 13 by the heat generation of the heating element 10 until the disappearance of the film boiling bubble 13. The first UFB 11A, the second UFB 11B, the third UFB 11C, and the fifth UFB 11E occur in the vicinity of the front surface of the film boiling bubble that occurs by film boiling. Here, the vicinity is the area within about 20 μm from the front surface of the film boiling bubble. The fourth UFB 11D occurs in the area in which the impact wave that occurs at the time of disappearance (extinction) of the air bubble propagates. In the example described above, the example until the film boiling bubble 13 disappears is shown, but generation of the UFB is not limited to this. For example, it is possible to generate the UFB also in a case where the film boiling bubble 13 does not disappear by communicating with the atmosphere before the generated film boiling bubble 13 disappears.

Next, a survival characteristic of the UFB is explained. The higher the temperature of the liquid, the lower the solubility characteristic of the gas component is and the lower the temperature, the higher the solubility characteristic of the gas component is. That is, the higher the temperature of the liquid, the more the phase transition of the dissolved gas component is facilitated and the UFB becomes more likely to be generated. The liquid temperature and the gas solubility is in an inversely proportional relationship and by the rise of the liquid temperature, the gas having exceeded the saturated solubility becomes an air bubble and precipitates into the liquid.

Because of this, in a case where the liquid temperature rises suddenly from the normal temperature, the solubility characteristic drops at a stretch and the UFB begins to be generated. Then, as the temperature rises, the thermal solubility characteristic becomes low and the situation in which the many UFBs are generated is brought about.

On the contrary, in a case where the liquid temperature drops from the normal temperature, the gas solubility characteristic becomes high and the generated UFB becomes more likely to liquefy. However, the temperature such as this is sufficiently lower than the normal temperature. Further, even though the liquid temperature drops, the UFB having occurred once has a high internal pressure and a high air-liquid interface energy, and therefore, the possibility that a pressure high enough to destroy the air-liquid interface acts is very faint. That is, the UFB having been generated once does not simply become extinct as long as the liquid is preserved at the normal temperature and pressure.

In the present embodiment, it can be said that the first UFB 11A explained in FIG. 7A to FIG. 7C, the third UFB 11C explained in FIG. 9A to FIG. 9C, and the fifth UFB 11E explained in FIG. 11A and FIG. 11B are the UFBs generated by making use of the thermal solubility characteristic of the gas such as this.

On the other hand, in the relationship between the liquid pressure and the solubility characteristic, the higher the liquid pressure, the higher the gas solubility characteristic is and the lower the pressure, the lower the solubility characteristic is. That is, the lower the liquid pressure, the more the phase transition into gas within the gas-dissolved liquid dissolved in the liquid is facilitated, and therefore, the UFB becomes more likely to be generated. In a case where the liquid pressure drops from the normal pressure, the solubility characteristic becomes low at a stretch and the UFB begins to be generated. Then, as the pressure drops, the pressure solubility characteristic becomes low and the situation in which the many UFBs are generated is brought about.

On the contrary, in a case where the liquid pressure rises from the normal pressure, the gas solubility characteristic becomes high and the generated UFB becomes more likely to liquefy. However, the pressure such as this is sufficiently higher than the atmospheric pressure and further, even though the liquid pressure rises, the UFB having occurred once has a high internal pressure a high air-liquid interface energy, and therefore, the possibility that a pressure high enough to destroy the air-liquid interface acts is very faint. That is, the UFB having been generated once does not simply become extinct as long as the liquid is preserved at the normal temperature and pressure.

In the present embodiment, it can be said that the second UFB 11B explained in FIG. 8A to FIG. 8C and the fourth UFB 11D explained in FIG. 10A and FIG. 10B are the UFBs generated by making use of the pressure solubility characteristic of the gas such as this.

In the above, the first to fourth UFBs whose generation factors are different are explained individually, but the above-described generation factors occur simultaneously at many portions accompanying the event, that is, the film boiling. Because of this, there is a case where at least two or more kinds of UFB among the first to fourth UFBs are generated at the same time or a case where the UFB is generated by the cooperation of these generation factors with each other. However, it is common to all the generation factors that these generation factors are brought about accompanying the change in the volume of the film boiling bubble that is generated by the film boiling phenomenon. In the present specification, the method of generating the UFB by making use of film boiling accompanying the sudden heat generation such as this is referred to as the T-UFB (Thermal-Ultra Fine Bubble) generation method. Further, the UFB generated by the T-UFB generation method is referred to as T-UFB and the liquid containing the T-UFB generated by the T-UFB generation method is referred to as T-UFB-contained liquid.

Almost all the air bubbles generated by the T-UFB generation method have a diameter of 1.0 μm or less and a milli-bubble and a micro bubble are unlikely to be generated. That is, according to the T-UFB generation method, the UFB is generated dominantly and efficiently. Further, the T-UFB that is generated by the T-UFB generation method has a higher air-liquid interface energy than that of the UFB generated by the conventional method and does not simply become extinct as long as being preserved at the normal temperature and pressure. Furthermore, even in a case where a new T-UFB is generated by new film boiling, the extinction of the T-UFB generated previously due to the impact is also suppressed. That is, it can be said that the number of T-UFBs included in the T-UFB-contained liquid and the concentration thereof have the hysteresis characteristic for the number of times of occurrence of film boiling in the T-UFB-contained liquid. In other words, it is possible to adjust the concentration of the T-UFB included in the T-UFB-contained liquid by controlling the number of heating elements arranged in the T-UFB generation unit 300 and the number of times of application of the voltage pulse to the heating element.

FIG. 1 is referred to again. In a case where the T-UFB-contained liquid W having a desired UFB concentration is generated in the T-UFB generation unit 300, the T-UFB-contained liquid W is supplied to the post-processing unit 400.

Figure 12A:
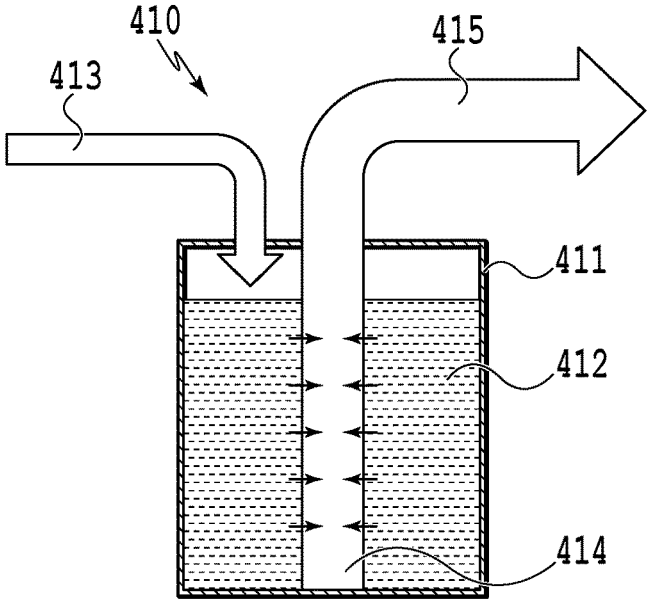
FIG. 12A to FIG. 12C are each a diagram showing a configuration example of a post-processing unit.
Figure 12B:
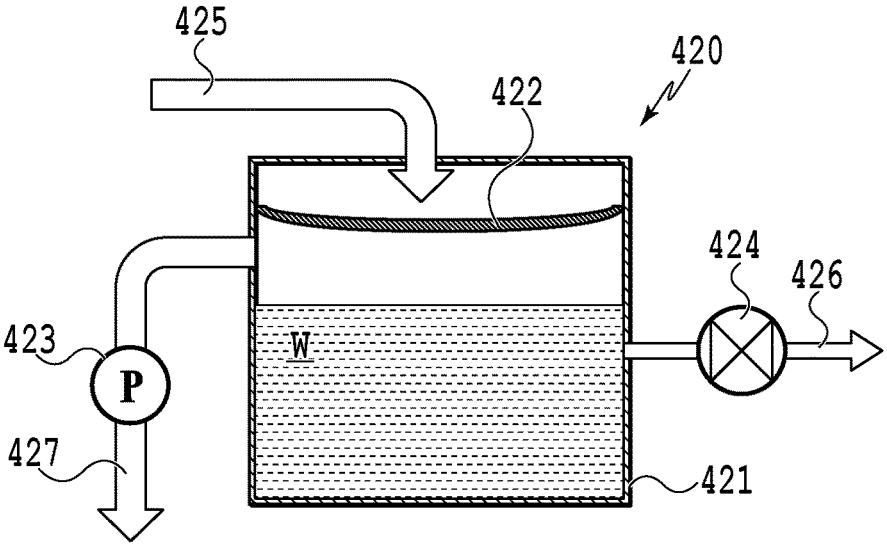
Figure 12C:
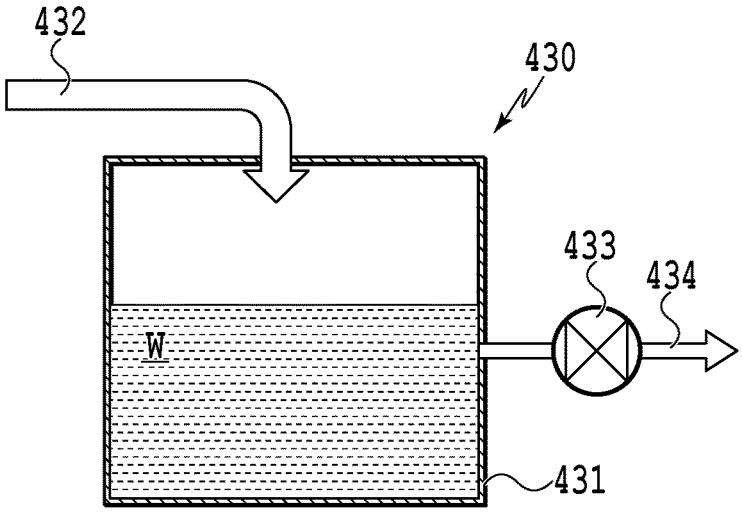

FIG. 12A to FIG. 12C are each a diagram showing a configuration example of the post-processing unit 400 of the present embodiment. The post-processing unit 400 of the present embodiment removes impurities included in the UFB-contained liquid W stepwise in order from the inorganic ion, the organic matter, and the insoluble solid.

FIG. 12A shows a first post-processing mechanism 410 for removing the inorganic ion. The first post-processing mechanism 410 comprises an exchange container 411, a cation exchange resin 412, a liquid introduction passage 413, a water collection pipe 414, and a liquid discharge passage 415. In the exchange container 411, the cation exchange resin 412 is accommodated. The UFB-contained liquid W generated in the T-UFB generation unit 300 is injected into the exchange container 411 via the liquid introduction passage 413, absorbed by the cation exchange resin 412, and the cations as impurities are removed here. The impurities such as these include metal materials that flake off from the element substrate 12 of the T-UFB generation unit 300 and the like and mention is made of, for example, $SiO_2$, SiN, SiC, Ta, $Al_2O_3$, $Ta_2O_5$, Ir and the like.

The cation exchange resin 412 is a synthetic resin obtained by introducing the functional group (ion exchange group) into the high molecular matrix having a three-dimensional mesh structure and the synthetic resin exhibits a spherical particle having a diameter of about 0.4 to 0.7 mm. The high molecular matrix is generally a copolymer of styrene-divinylbenzene and as the functional group, for example, it is possible to use the methacrylic acid-based functional group or the acrylic acid-based functional group. However, the above-described materials are examples. As long as it is possible to effectively remove desired inorganic ions, the above-described materials can be changed in a variety of ways. The UFB-contained liquid W absorbed by the cation exchange resin 412 and from which inorganic ions are removed are collected by the water collection pipe 414 and sent to the next process via the liquid discharge passage 415. In this process in the present embodiment, it is not necessary for all inorganic ions included within the UFB-contained liquid W that is supplied from the liquid introduction passage 413 to be removed and it is sufficient to remove at least a part of inorganic ions.

FIG. 12B shows a second post-processing mechanism 420 for removing the organic matter. The second post-processing mechanism 420 comprises an accommodation container 421, a filtration filter 422, a vacuum pump 423, a valve 424, a liquid introduction passage 425, a liquid discharge passage 426, and an air suction passage 427. The inside of the accommodation container 421 is divided into two areas, that is, an upper area and a lower area by the filtration filter 422. The liquid introduction passage 425 connects to the upper area of the two upper and lower areas and the air suction passage 427 and the liquid discharge passage 426 connect to the lower area. In a case where the vacuum pump 423 is driven in the state where the valve 424 is closed, the air within the accommodation container 421 is discharged via the air suction passage 427 and the pressure of the inside of the accommodation container 421 becomes a negative pressure and the UFB-contained liquid W is introduced by the liquid introduction passage 425. Then, the UFB-contained liquid W in the state where impurities are removed by the filtration filter 422 is stored in the accommodation container 421.

The impurities that are removed by the filtration filter 422 include organic materials that can be mixed in a tube or each unit and mention is made of, for example, organic compounds including silicon, siloxane, epoxy and the like. As the filter film that can be used as the filtration filter 422, mention is made of a micrometer (hereinafter, sometimes described as μm) mesh filter (filter having a mesh diameter of 1 μm or less) capable of removing substances as small as bacteria and a nanometer (hereinafter, sometimes described as nm) mesh filter capable of removing substances as small as viruses. The filtration filter having the fine opening diameter such as this may also remove an air bubble whose diameter is larger than the filter opening diameter. Particularly, in a case where a fine air bubble sticks to the opening (mesh) of the filter, clogging of the filter will result and the filtration speed may be reduced. However, almost all the air bubbles generated by the T-UFB generation method explained in the invention of the present embodiment have a diameter of 1.0 μm or less and the milli-bubbles and micro bubbles having a diameter of 1.0 μm or more are unlikely to be generated. That is, the generation ratio of the milli-bubble and the micro bubble is very low, and therefore, it is possible to suppress a reduction in the filtration speed, which is caused by the air bubble sticking to the filter. Consequently, it is possible to favorably apply the filtration filter 422 comprising the filter having a mesh diameter of 1 μm or less to the system comprising the T-UFB generation method.

As an example of the filtration method that can be applied to the present embodiment, there are a so-called dead end filtration method and a cross-flow filtration method. In the dead end filtration method, the direction in which the supplied liquid flows and the direction in which the filtration liquid that passes through the filter opening flows are the same, that is, both liquids flow in the directions parallel to each other. In contrast to this, in the cross-flow filtration method, the supplied liquid flows in the direction along the filter surface, that is, the supplied liquid and the filtration liquid that passes through the filter opening flow in the directions intersecting with each other. In order to suppress the air bubble from sticking to the filter opening, it is preferable to apply the cross-flow filtration method.

After a certain amount of the UFB-contained liquid W is stored in the accommodation container 421, in a case where the vacuum pump 423 is stopped and the valve 424 is opened, the T-UFB-contained liquid in the accommodation container 421 is sent to the next process via the liquid discharge passage 426. Here, as the method of removing organic impurities, the vacuum filtration method is adopted, but as the filtration method using a filter, it may also be possible to adopt, for example, the gravity filtration or the pressure filtration method.

FIG. 12C shows a third post-processing mechanism 430 for removing the insoluble solid. The third post-processing mechanism 430 comprises a precipitation container 431, a liquid introduction passage 432, a valve 433, and a liquid discharge passage 434.

First, in the state where the valve 433 is closed, a predetermined amount of the UFB-contained liquid W is stored in the precipitation container 431 through the liquid introduction passage 432 and this state is left as it is a while.

During this time, the solid included in the UFB-contained liquid W precipitates on the bottom of the precipitation container 431 by the gravity. Further, among the bubbles included in the UFB-contained liquid, the bubble whose size is comparatively large, such as the micro bubble, floats up to the liquid surface by the buoyant force and is removed from the UFB-contained liquid. In a case where the valve 433 is opened after a sufficiently long time elapses, the UFB-contained liquid W from which the solid and the large-size bubble have been removed is sent to the collection unit 500 via the liquid discharge passage 434. In the present embodiment, the example is shown in which the three post-processing mechanisms are applied in order, but the order is not limited to this and it may also be possible to change the order of the three post-processing mechanisms or it may also be possible to adopt at least one post-processing mechanism in accordance with the necessity.

FIG. 1 is referred to again. It may also be possible to send the T-UFB-contained liquid W from which impurities have been removed by the post-processing mechanism 400 to the collection unit 500 as it is, but it is also possible to return it again to the dissolving unit 200. In a case of the latter, it is possible to increase the gas solubility concentration of the T-UFB-contained liquid W, which has dropped by generation of the T-UFB, to the saturated state again in the dissolving unit 200. After that, in a case where a new T-UFB is generated by the T-UFB generation unit 300, under the above-described characteristic, it is possible to further increase the UFB content concentration of the T-UFB-contained liquid. That is, it is possible to increase the UFB content concentration by an amount corresponding to the number of times of circulation through the dissolving unit 200, the T-UFB generation unit 300, and the post-processing unit 400 and after a desired UFB content concentration is obtained, it is possible to send the UFB-contained liquid W to the collection unit 500. In the present embodiment, the aspect is shown in which the UFB-contained liquid having been processed in the post-processing unit 400 is returned to the dissolving unit 200 and circulated. However, this is not limited and for example, before supplying the liquid to the post-processing unit 400 after the liquid has passed the T-UFB generation unit, it may also be possible to perform the post-processing in the post-processing unit 400 after increasing the T-FUB concentration by returning the liquid to the dissolving unit 200 again and performing circulation a plurality of times.

The collection unit 500 collects and preserves the UFB-contained liquid W sent from the post-processing unit 400. The T-UFB-contained liquid collected by the collection unit 500 is a UFB-contained liquid from which various impurities have been removed and having a high purity.

In the collection unit 500, it may also be possible to perform the filtering processing in several stages and classify the UFB-contained liquid W according to T-UFB size. Further, it is expected that the T-UFB-contained liquid W obtained by the T-UFB method has a temperature higher than the normal temperature, and therefore, it may also be possible to provide a cooling unit in the collection unit 500. It may also be possible to provide the cooling unit such as this in a part of the post-processing unit 400.

The above is the outline of the UFB generation apparatus 1 and it is of course possible to change the plurality of units shown schematically and it is not necessary to prepare all the units. It may also be possible to omit a part of the above-described units in accordance with the kind of the liquid W and the gas G that are used or the purpose of use of the T-UFB-contained liquid W that is generated, and it may also be possible to further add another unit other than the above-described units.

For example, in a case where the gas that is contained in the UFB is the atmosphere, it is possible to omit the deaeration unit 100 and the dissolving unit 200 as the preprocessing unit. On the contrary, in a case where it is desired to contain a plurality of kinds of gas in the UFB, it may also be possible to further add the dissolving unit 200.

Further, it may also be possible to provide the units for removing impurities as shown in FIG. 12A to FIG. 12C at the upstream of the T-UFB generation unit 300 or provide them at both the upstream and the downstream. In a case where the liquid that is supplied to the UFB generation apparatus is tap water, rainwater, contaminated water or the like, it may happen that organic-based or inorganic-based impurities are included in the liquid. In a case where the liquid W including the impurities such as those is supplied to the T-UFB generation unit 300, there is a possibility that the heating element 10 degenerates or a salting-out phenomenon is brought about. By providing the mechanisms as shown in FIG. 12A to FIG. 12C at the upstream of the T-UFB generation unit 300, it is possible to remove in advance the impurities as described above.

<<Specific Example of T-UFB Generation Apparatus>>

Next, a specific layout of the UFB generation apparatus for efficiently performing ultra fine bubble generation is explained by taking some embodiments.

First Embodiment

In the present embodiment, the UFB generation efficiency is improved by installing a UFB circulation blocking unit configured to block the UFB from flowing into the circulation path between the UFB generation unit and the circulation pump among the members configuring the UFB generation apparatus.

Figure 13:
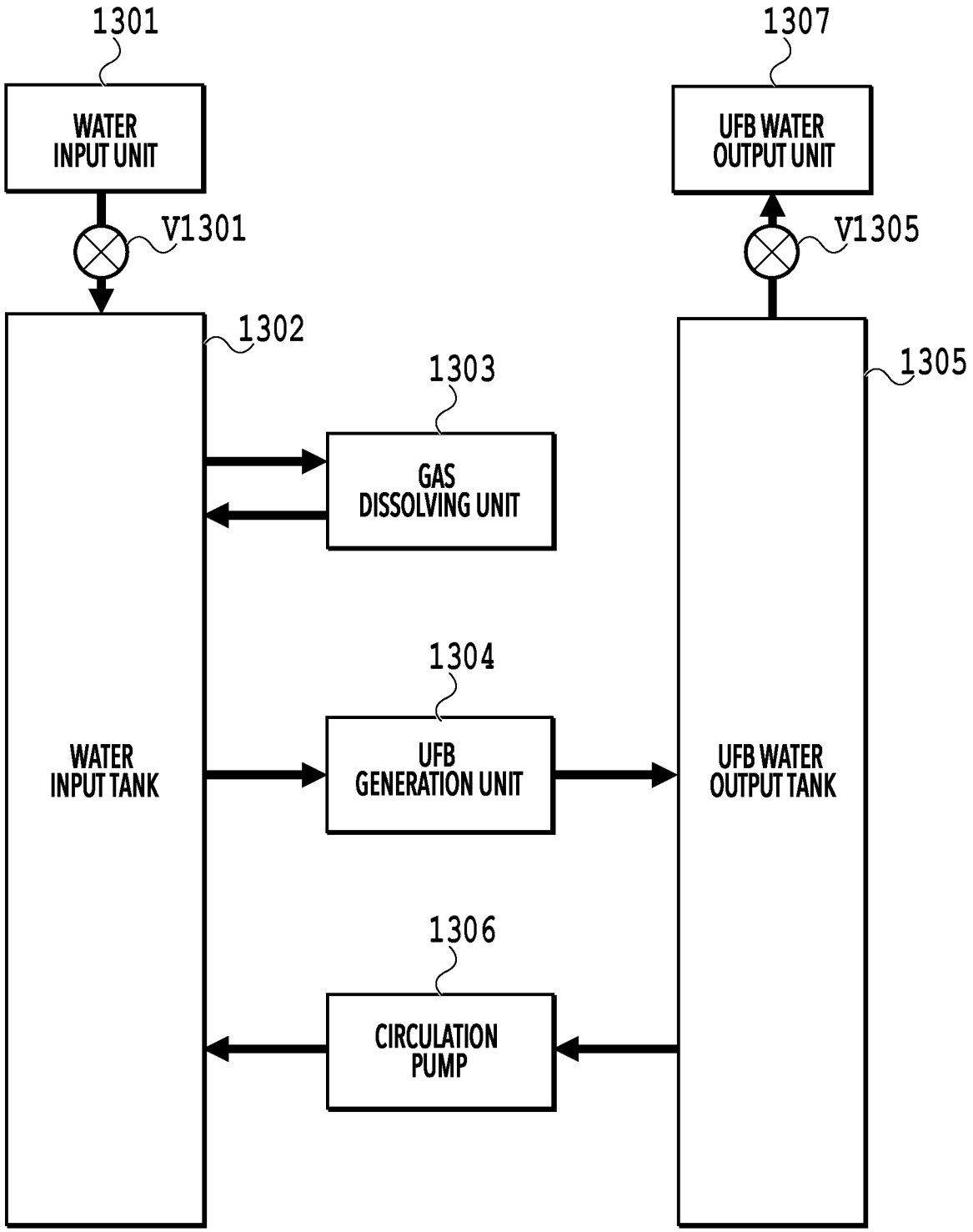
FIG. 13 is a diagram showing a configuration of a conventional UFB generation apparatus.

FIG. 13 shows the configuration of a conventional UFB generation apparatus. A water input tank 1302 and a gas dissolving unit 1303 in FIG. 13 correspond to the dissolving unit 200 in FIG. 1, a UFB generation unit 1304 in FIG. 13 corresponds to the T-UFB generation unit 300 in FIG. 1, and a UFB water output tank 1305 in FIG. 13 corresponds to the post-processing unit 400 in FIG. 1.

A water input unit 1301 has a role to input water that is the target of UFB generation and supply the input water to the water input tank 1302. The water input tank 1302 has a role to receive supply of water from the water input unit 1301 and supply the supplied water to the gas dissolving unit 1303. The gas dissolving unit 1303 has a role to receive supply of water from the water input tank 1302, generate gas-dissolved water obtained by dissolving a gas in the supplied water, and supply the generated gas-dissolved water to the water input tank 1302. As the gas dissolving method, it is possible to use the pressure dissolving method, bubbling and the like.

The UFB generation unit 1304 has a heater as the heating element that causes film boiling to take place. The UFB generation unit 1304 has a role to generate the UFB by receiving supply of the gas-dissolved water from the water input tank 1302 and supply the water (referred to as UFB water) including the generated UFB to the UFB water output tank 1305. The UFB water output tank 1305 has a role to receive supply of the UFB water from the UFB generation unit 1304 and supply the supplied UFB water to a circulation pump 1306 and a UFB water output unit 1307. The circulation pump 1306 has a role to receive supply of the UFB water from the UFB water output tank 1305 and supply the supplied UFB water to the water input tank 1302.

Between the water input unit 1301 and the water input tank 1302, there is a valve V1301 and between the UFB water output tank 1305 and the UFB water output unit 1307, there is a valve V1305. These valves are in the connected state, respectively, at the time of generating the UFB water and on the other hand, at the time of terminating the generation of the UFB water, these valves are in the shut-off state. Further, in a case where exchange or maintenance of the gas dissolving unit 1303, the UFB generation unit 1304 and the like is performed, exchange processing or maintenance processing is performed by shutting off the valve V1301 and the valve V1305. In a case where the exchange processing is completed, the UFB generation is resumed by bringing the valve V1301 and the valve V1305 into the connected state.

As described above, in the conventional UFB generation apparatus, the UFB generated in the UFB generation unit 1304 is input again to the UFB generation unit 1304 via the UFB water output tank 1305, the circulation pump 1306, and the water input tank 1302. Because of the configuration such as this, the existence of the UFB already generated reduces the UFB generation efficiency. This is a very big problem for the device that needs the high-concentration UFB, such as a medical device. The present embodiment solves this problem.

Figure 14:
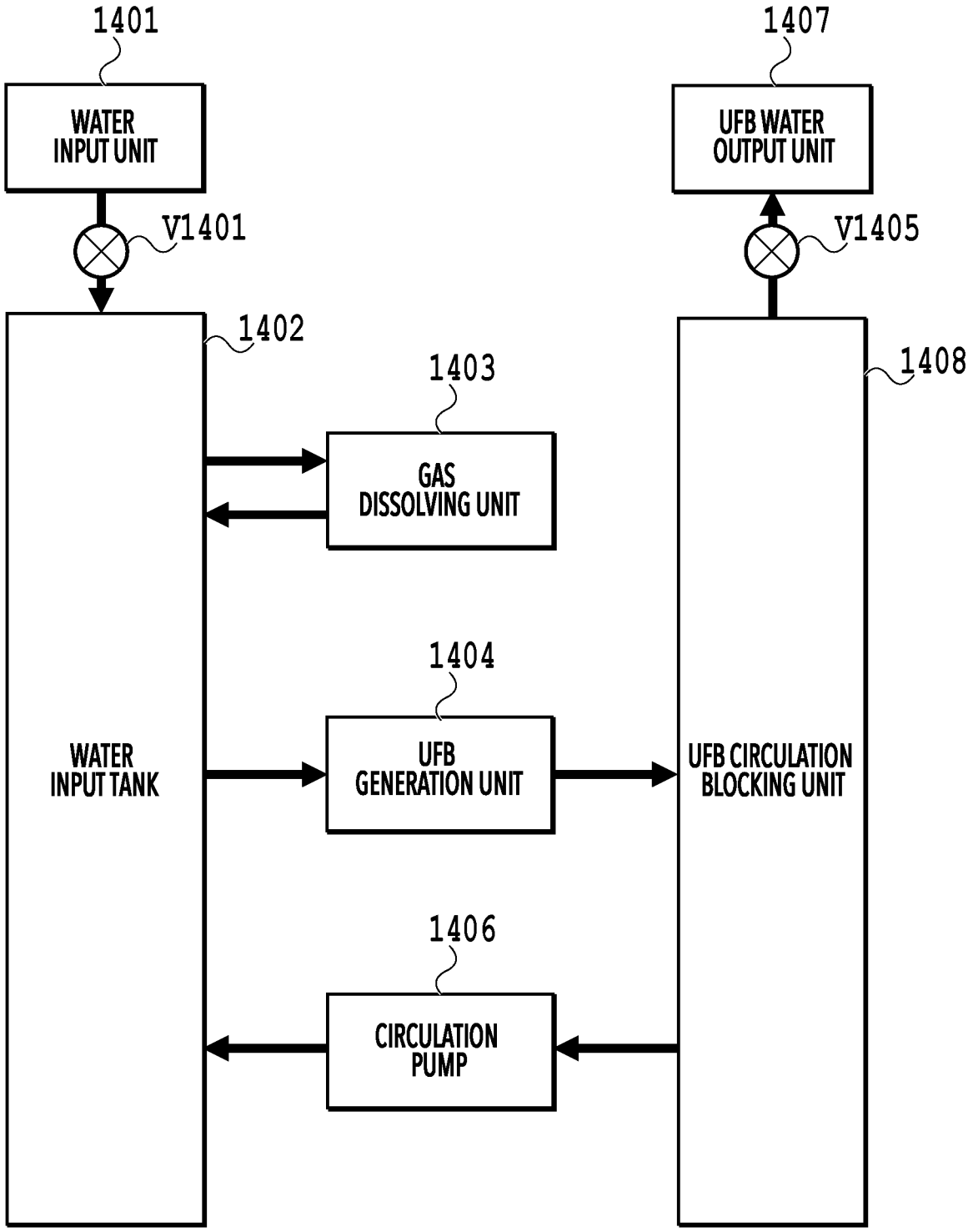
FIG. 14 is a diagram showing a configuration of a UFB generation apparatus in a first embodiment.

FIG. 14 shows the configuration of a UFB generation apparatus in the present embodiment. A water input unit 1401 to a gas dissolving unit 1403 in FIG. 14 are the same as the water input unit 1301 to the gas dissolving unit 1303 in FIG. 13, and therefore, explanation is omitted.

A UFB generation unit 1404 has a heater, The UFB generation unit 1404 has a role to receive supply of the gas-dissolved water from the water input tank 1402 and generate the UFB and supply the UFB water to a UFB circulation blocking unit 1408. The UFB circulation blocking unit 1408 has a role to provide water whose UFB concentration has been reduced to a circulation pump 1406 as well as receiving supply of the UFB water from the UFB generation unit 1404 and supplying the supplied UFB water to a UFB water output unit 1407. The circulation pump 1406 has a role to receive supply of the water whose UFB concentration has been reduced from the UFB circulation blocking unit 1408 and supply the supplied water to the water input tank 1402 via a liquid passage.

By designing the configuration such as this, compared to the conventional UFB generation apparatus (see FIG. 13), the UFB concentration in the water that is supplied to the water input tank 1402 via the circulation pump 1406 is reduced, and therefore, the UFB generation efficiency in the UFB generation unit 1404 improves. Between the water input unit 1401 and the water input tank 1402, there is a valve V1401 and between the UFB circulation blocking unit 1408 and the UFB water output unit 1407, there is a valve V1405, but the control of these valves is the same as that of the conventional UFB generation apparatus (see FIG. 13), and therefore, explanation is omitted. In the present embodiment, the example is shown in which the UFB water is supplied (input again) to the water input tank 1402 by the circulation pump 1406, but an aspect may be accepted in which the UFB water is supplied to the water input tank by the water head difference by, for example, changing the position of the storage tank of the liquid without using the circulation pump.

As above, according to the present embodiment, the UFB concentration in the water that is supplied to the UFB generation unit 1404 is suppressed low, and therefore, compared to the conventional UFB generation apparatus, it is possible to improve the UFB generation efficiency.

Figure 15:
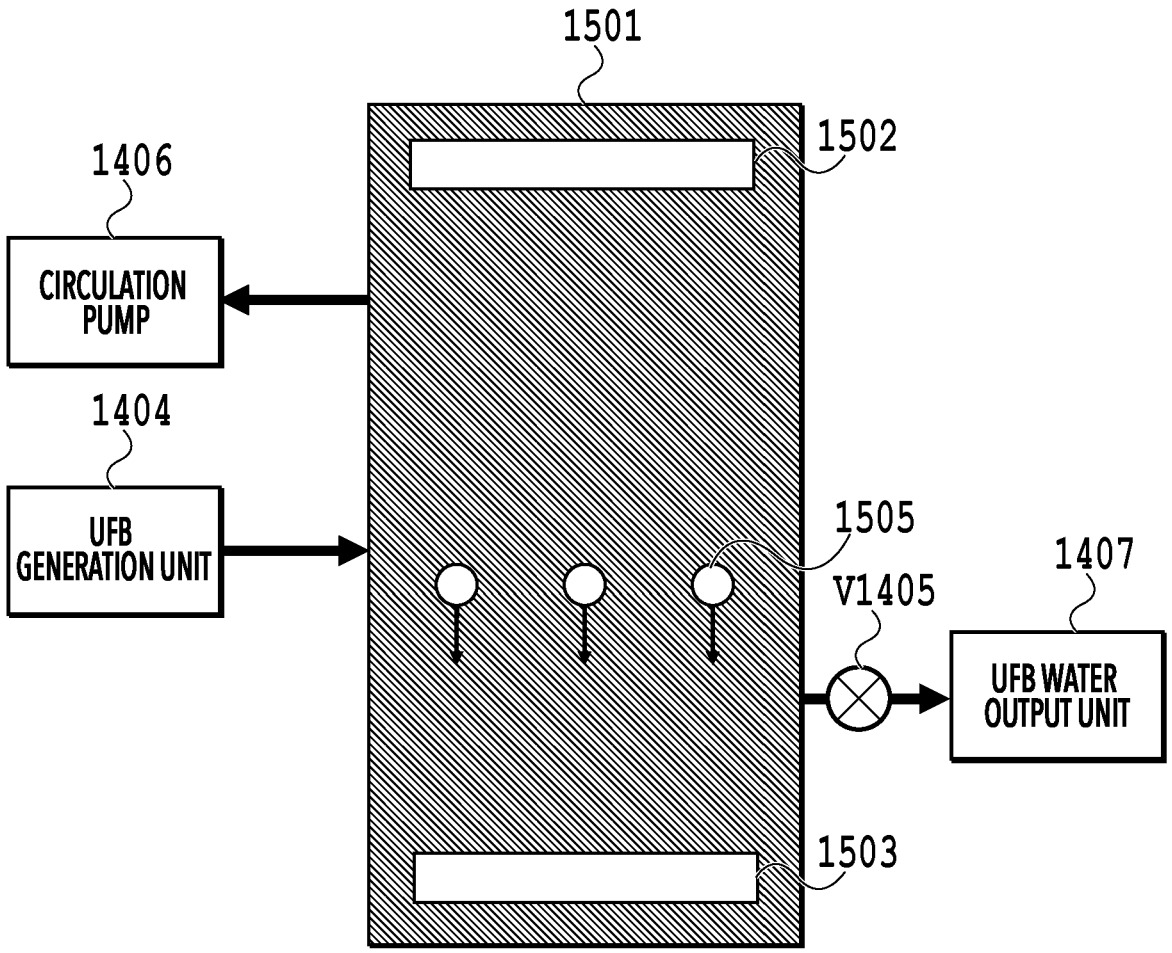
FIG. 15 is a diagram showing a configuration of a UFB circulation blocking unit in the first embodiment.

FIG. 15 shows the detailed configuration of the UFB circulation blocking unit in the present embodiment. In the present embodiment, in order to collect the UFB included in the UFB water supplied from the UFB generation unit 1404 on the side of the UFB water output unit 1407 rather than the circulation pump 1406, electric field control is used. In FIG. 5, sign 1501 indicates the entire UFB circulation blocking unit and this corresponds to the UFB circulation blocking unit 1408 in FIG. 14. In FIG. 15, for simplicity, the water input unit, the water input tank, and the gas dissolving unit are not shown schematically.

An electrode (−) 1502 and an electrode (+) 1503 are blocking configurations for blocking circulation of the UFB and have a role to guide a UFB 1505 charged negative to the side of the UFB output unit 1407 located at the lower portion in FIG. 15. In FIG. 15, for convenience of explanation, the electrode (−) 1502 and the electrode (+) 1503 are installed inside a UFB circulation blocking unit 1501. However, as long as it is possible to produce the electric field to guide the UFB, the negative electrode and the positive electrode may be installed outside the UFB circulation blocking unit.

By designing the configuration such as this, the gas dissolving and the UFB generation are performed again for the water having returned to the water input tank 1402 via the circulation pump 1406. Then, the UFB included in the UFB water sent again to the UFB circulation blocking unit 1501 is guided to the side of the UFB water output unit 1407 located under the UFB circulation blocking unit 1501 and stays within the UFB circulation blocking unit 1501.

In a case where the circulation blocking unit in the present embodiment is adopted as above, the UFB concentration on the side of the UFB water output unit 1407 increases and on the other hand, the UFB concentration on the side of the circulation pump 1406 decreases. Consequently, it is possible to reduce the UFB concentration in the water that is sent to the UFB generation unit 1404 via the circulation pump 1406, and therefore, it is possible to improve the UFB generation efficiency.

Second Embodiment

In the first embodiment, the UFB is collected by using the electric field control. In contrast to this, in the present embodiment, the UFB is collected by using a physical filter.

Figure 16:
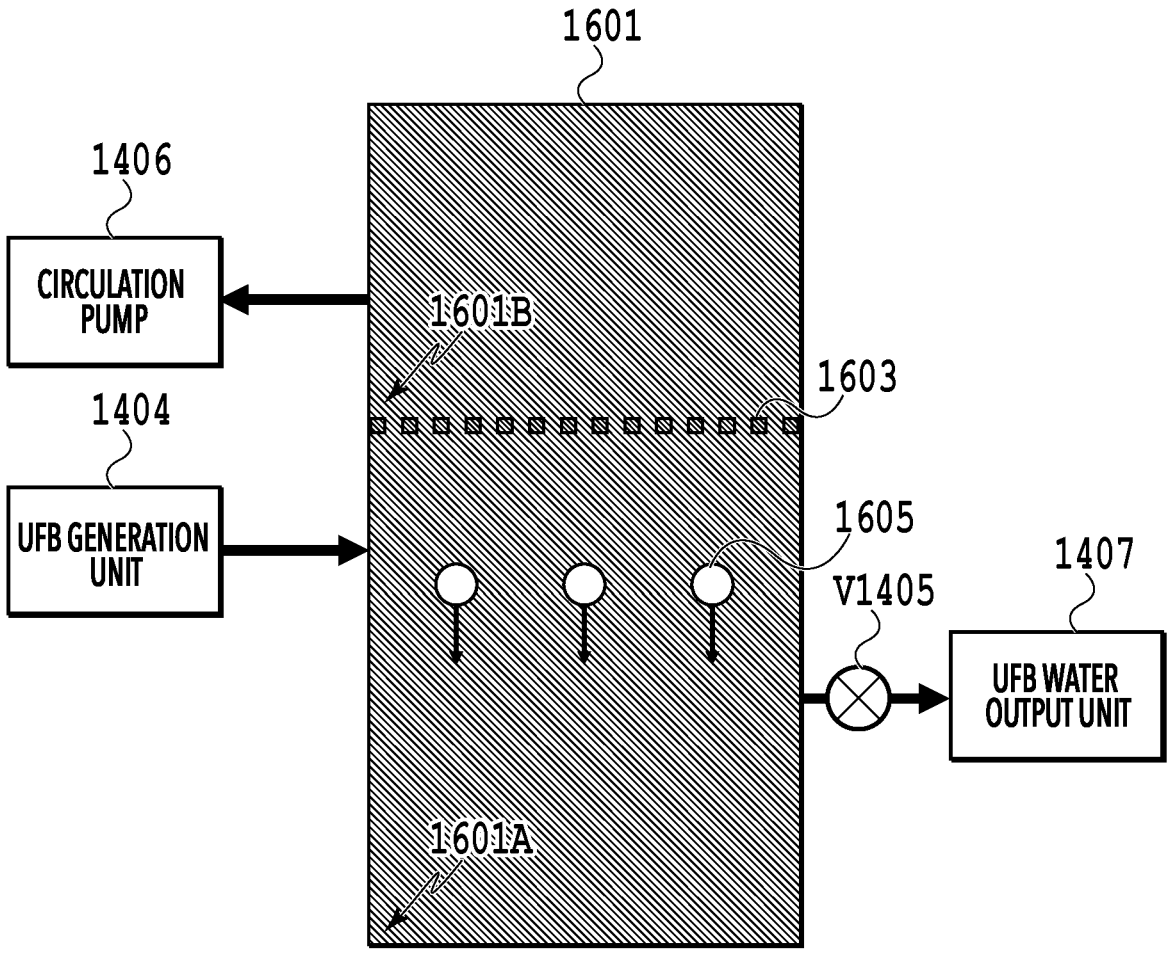
FIG. 16 is a diagram showing a configuration of a UFB circulation blocking unit in a second embodiment.

FIG. 16 shows the detailed configuration of a UFB circulation blocking unit in the present embodiment. As shown in FIG. 16, a UFB generation apparatus in the present embodiment has a UFB circulation blocking unit 1601. This corresponds to the UFB circulation blocking unit 1408 in FIG. 14. In FIG. 16, for simplicity, the water input unit, the water input tank, and the gas dissolving unit are not shown schematically.

A nm filter 1603 is a physical filter whose mesh has a diameter smaller than the diameter of the UFB and has the characteristic that allows water to pass therethrough but does not allow the UFB to pass therethrough. By this nm filter 1603, the UFB circulation blocking unit 1601 is divided into two areas, that is, a UFB water output area 1610A and a UFB circulation blocking area 1601B.

The UFB generation unit 1404 and the UFB water output unit 1407 are connected to the UFB water output area 1610A and the circulation pump 1406 is connected to the UFB circulation blocking area 1601B. By designing the configuration such as this, it is possible to bring about a state where UFB 1605 exists in the UFB water output area 1610A but in the UFB circulation blocking area 1601B, almost no UFB 1605 exists because the invasion of the UFB 1605 is prevented by the nm filter 1603.

In a case where UFB generation is performed in the state as shown in FIG. 16, the gas dissolving and the UFB generation are performed again for the water having returned to the water input tank via the circulation pump 1406. Then, the UFB included in the UFB water sent again to the UFB circulation blocking unit 1601 cannot advance to the UFB circulation blocking area 1601B and stays in the UFB water output area 1610A. In this manner, the UFB concentration of the UFB water output area 1610A increases, but the UFB concentration in the water that is sent to the UFB generation unit 1404 via the circulation pump 1406 has decreased, and therefore, the UFB generation efficiency improves.

Third Embodiment

In the first embodiment, the UFB is collected by using the electric field control. In contrast to this, in the present embodiment, the UFB is collected while simultaneously removing a μB (micro bubble). At the time of a gas dissolved and existing in water entering the supersaturated solubility state in some form and precipitating as a gas, in a case where there exists an interface with the μB on the periphery, there is a possibility that a phenomenon in which the gas precipitates from the interface and dose not become the UFB occurs. The present embodiment is for dealing with the phenomenon such as this.

Figure 17:
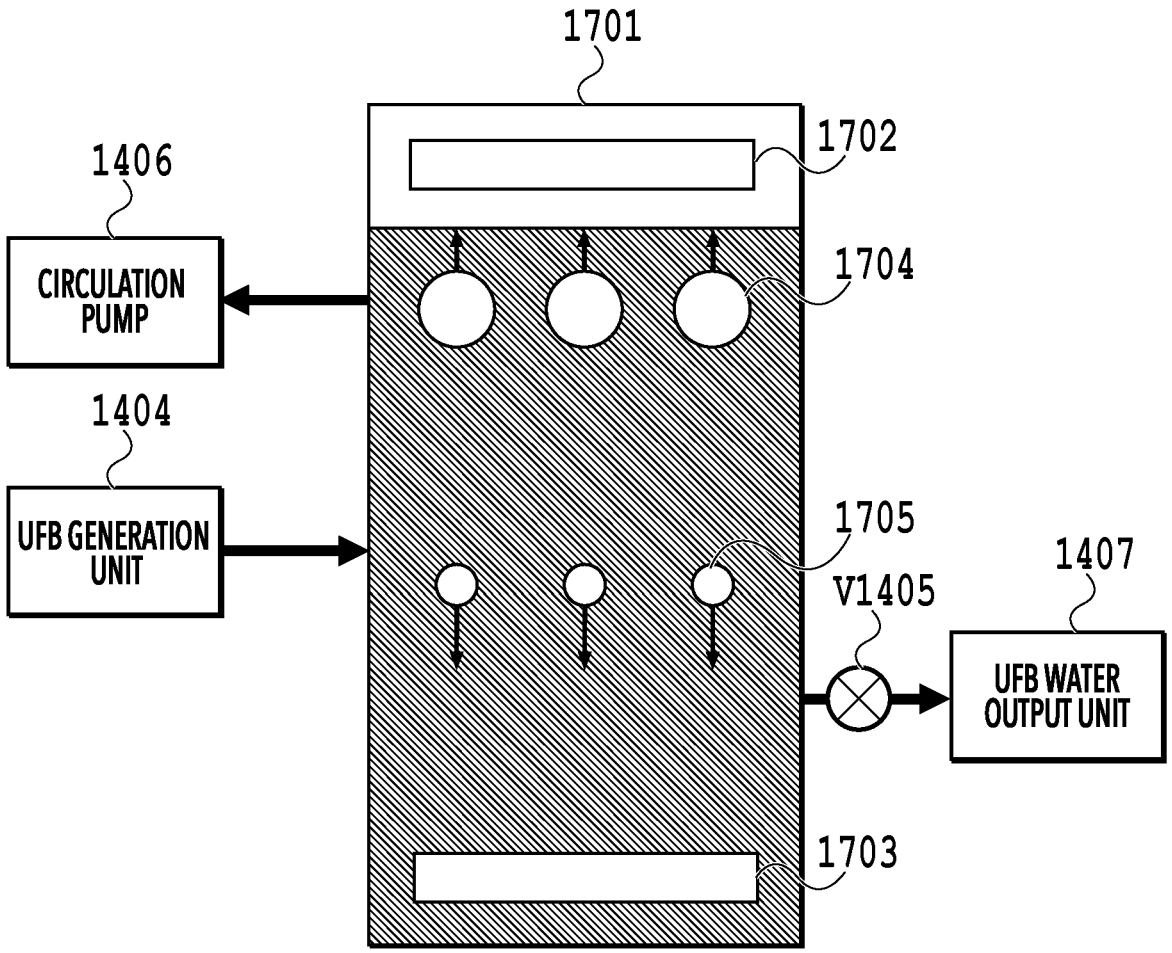
FIG. 17 is a diagram showing a configuration of a UFB circulation blocking unit in a third embodiment.

FIG. 17 shows the detailed configuration of a UFB circulation blocking unit in the present embodiment. As shown in FIG. 17, a UFB generation apparatus in the present embodiment has a UFB circulation blocking unit 1701 and this UFB circulation blocking unit 1701 also has a role as a μB removal unit. An electrode (−) 1702, an electrode (+) 1703, and a UFB 1705 in FIG. 17 are the same as the electrode (−) 1502, the electrode (+) 1503, and the UFB 1505 in FIG. 15, and therefore, explanation is omitted. Further, in FIG. 17, for simplicity, the water input unit, the water input tank, and the gas dissolving unit are not shown schematically.

While the UFB circulation blocking unit 1501 in the first embodiment is filled full with the UFB water (see FIG. 15), the UFB circulation blocking unit 1701 in the present embodiment is filled with the UFB water only up to a certain height and on the UFB water, the gas exists and the air-liquid interface exists. The buoyant force of a μB 1704 is sufficiently large unlike the UFB 1705 and the μB 1704 rises by the buoyant force, and therefore, the μB 1704 having reached the water surface comes into contact with the gas and becomes extinct. By designing the UFB circulation blocking unit so as to have the configuration as shown in FIG. 17, it is made possible to suppress a reduction in the UFB generation efficiency, which results from the water including the μB reaching again the UFB generation unit 1404 via the circulation pump 1406.

In a case where the electric field between the electrode (−) 1702 and the electrode (+) 1703 is too strong, as a result of that the μB is, like the UFB, also guided in the downward direction in the UFB circulation blocking unit 1701, the time during which the μB stays in the UFB circulation blocking unit 1701 is prolonged. Further, in this case, as a result of that both the UFB and the μB are guided in the downward direction in the UFB circulation blocking unit 1701, the UFB and the μB collide with each other and are fused and a possibility is raised that the UFB concentration decreases.

Consequently, it is preferable to perform the control with an electric field having an electromagnetic induction force weaker than the buoyant force of the μB instead of the electric field having an electromagnetic induction force about the same magnitude as that of the buoyant force of the μB so that the stay time of the μB is not prolonged. Further preferably, in a case where the control is performed with an electric field whose electromagnetic induction force is less than or equal to half the buoyant force, it is possible to suppress the stay time of the μB to double the stay time at the maximum.

Preferably, the direction in which the UFB is guided by the electric field between the electrode (−) 1702 and the electrode (+) 1703 is opposite to the upward direction in which the μB rises in the water. That is, the buoyant force that causes the μB to rise in the water acts upward in the vertical direction (gravity direction), and therefore, the configuration is preferable in which the UFB is guided is the vertically downward direction, or at least in the direction more downward than the horizontal direction. In other words, it is preferable for the electrode (−) 1702 to be arranged on the side in the vertically upward direction of the electrode (+) 1703.

Fourth Embodiment

In the second embodiment, the UFB is collected by using the physical filter (see FIG. 16). In contrast to this, in the present embodiment, the UFB is collected by using a physical filter while simultaneously removing the μB.

Figure 18:
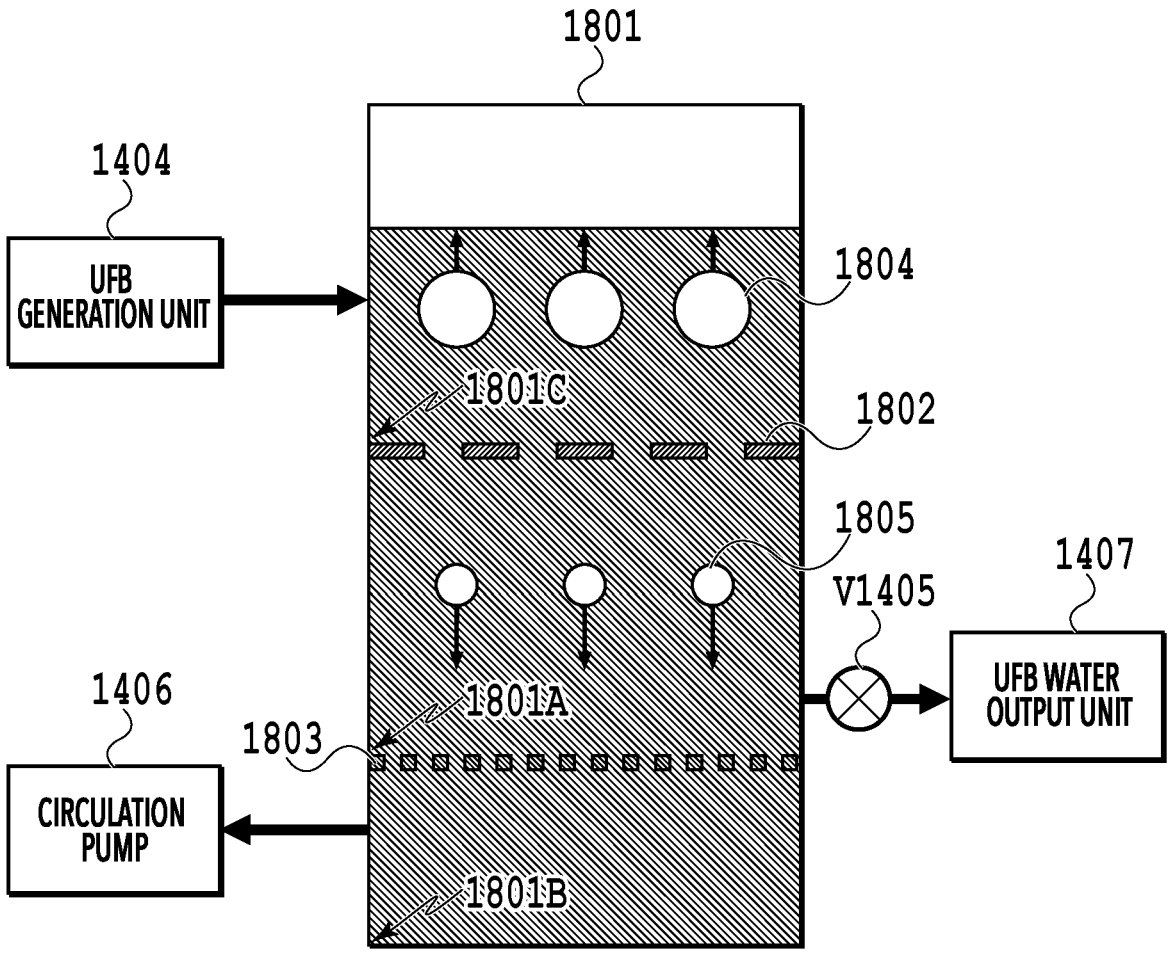
FIG. 18 is a diagram showing a configuration of a UFB circulation blocking unit in a fourth embodiment.

FIG. 18 shows the detailed configuration of a UFB circulation blocking unit in the present embodiment. As shown in FIG. 18, a UFB generation apparatus in the present embodiment has a UFB circulation blocking unit 1801 and this UFB circulation blocking unit 1801 also has a role as a μB removal unit. In FIG. 18, for simplicity, the water input unit, the water input tank, and the gas dissolving unit are not shown schematically.

A μm filter 1802 is a physical filter whose mesh has a diameter smaller than the diameter of the μB but larger than the diameter of the UFB, and has the characteristic that allows water and the UFB to pass therethrough but does not allow the μB to pass therethrough. A nm filter 1803 is a physical filter whose mesh has a diameter smaller than the diameter of the UFB and has the characteristic that allows water to pass therethrough but does not allow the UFB to pass therethrough. By the μm filter 1802 and the nm filter 1803, the UFB circulation blocking unit 1801 is divided into three areas, that is, a UFB water output area 1801A, a UFB circulation blocking area 1801B, and a μB removal area 1801C.

The UFB generation unit 1404 is connected to the μB removal area 1801C. The UFB water output unit 1407 is connected to the UFB water output area 1801A. The circulation pump 1406 is connected to the UFB circulation blocking area 1801B.

In the μB removal area 1801C, both the UFB and the μB exist. In the UFB water output area 1801A, as a result of that the invasion of the μB is prevented by the μm filter 1802, the UFB exists but almost no μB exists. In the UFB circulation blocking area 1801B, as a result of that the invasion of the UFB is prevented by the nm filter 1803, almost no UFB exists.

In a case where UFB generation is performed in the state shown in FIG. 18, the gas dissolving and the UFB generation are performed again for the water having returned to the water input tank via the circulation pump 1406. Then, a UFB 1805 included in the UFB water sent again to the UFB circulation blocking unit 1801 cannot advance to the UFB circulation blocking area 1801B and stays in the UFB water output area 1801A. In this manner, the UFB concentration of the UFB water within the UFB water output area 1801A increases but the UFB concentration in the water that is sent to the UFB generation unit via the circulation pump 1406 has decreased, and therefore, the UFB generation efficiency improves.

Further, while the UFB circulation blocking unit 1501 in the first embodiment is filled full with the UFB water, the UFB circulation blocking unit 1801 in the present embodiment is filled with the UFB water only up to a certain height and on the UFB water, the gas exists and the air-liquid interface exists. Consequently, as in the third embodiment (see FIG. 17), a μB 1804 having reached the water surface comes into contact with the atmosphere and disappears, and therefore, it is made possible to suppress a reduction in the UFB generation efficiency, which results from the water including the μB reaching again the UFB generation unit 1404 via the circulation pump 1406.

As explained above, in the present embodiment, the μB and the UFB are prevented from flowing into the circulation path and due to this, it is possible to improve the UFB generation efficiency.

Fifth Embodiment

Figure 19:
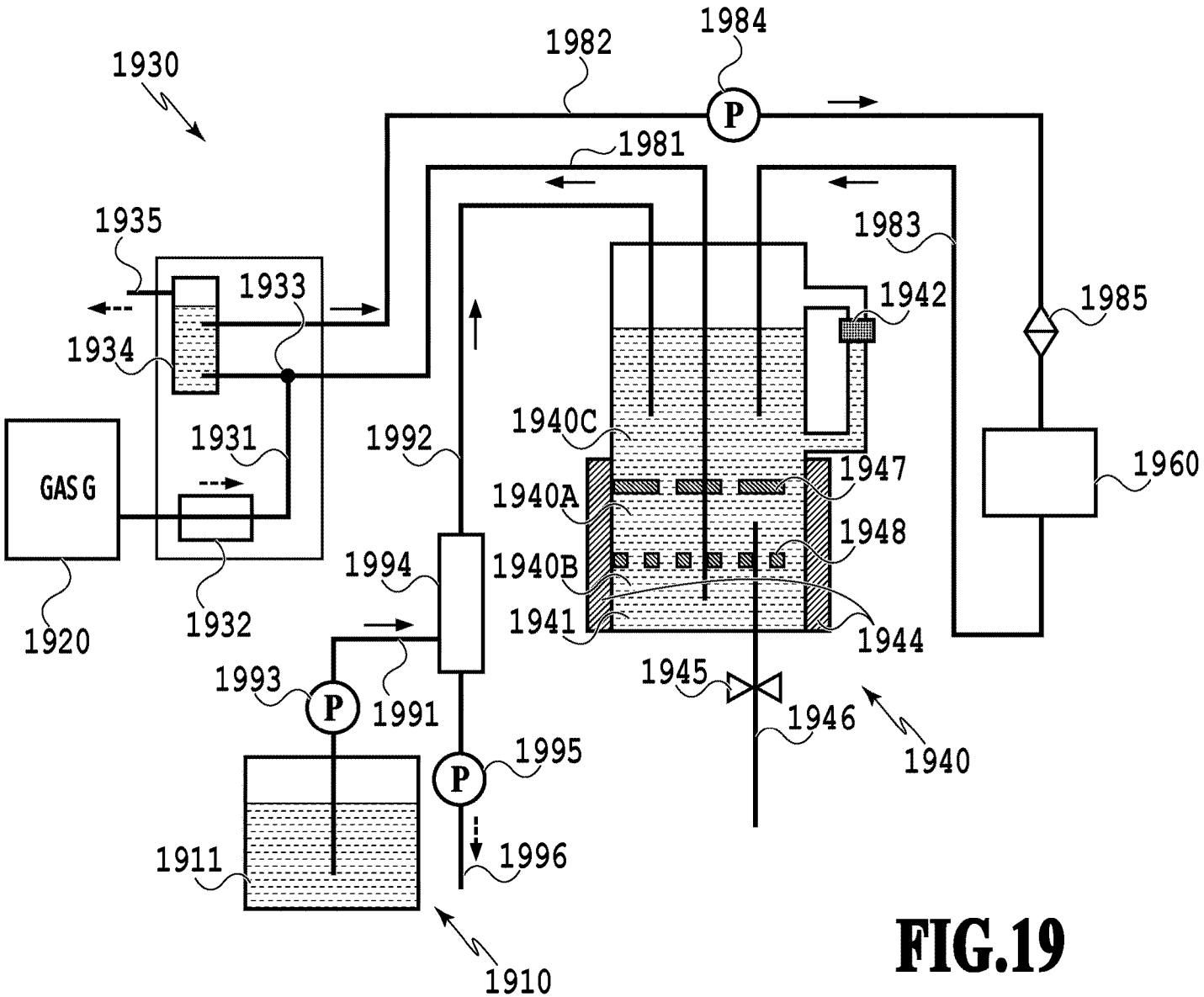
FIG. 19 is a diagram showing a configuration of a UFB generation apparatus in a fifth embodiment.

In the present embodiment, a configuration that integrates the water input tank and the UFB water output tank in the configuration explained so far is explained. FIG. 19 shows the configuration of a UFB generation apparatus in the present embodiment. As shown in FIG. 19, the UFB generation apparatus has a liquid supply unit 1910, a gas supply unit 1920, a gas dissolving unit 1930, a storage chamber 1940, and a UFB generation unit 1960 and these components are connected by pipes so that liquid and gas can move. A solid line arrow in FIG. 19 indicates a flow of the liquid and a broken line arrow indicates a flow of the gas.

In the liquid supply unit 1910, a liquid 1911 is stored. The liquid supply unit 1910 has a function to supply the liquid 1911 to the storage chamber 1940 through a pipe 1991 and a pipe 1992 by a pump 1993. At some portion in the path from the liquid supply unit 1910 to the storage chamber 1940, a deaeration unit 1994 is arranged so that the gas dissolved and existing in the liquid 1911 is removed. Inside the deaeration unit 1994, a film, not shown schematically, through which only the gas can pass is incorporated and by the gas passing through the film, the gas and the liquid are separated. The dissolved and existing gas is sucked by a pump 1995 and evacuated from an evacuation unit 1996. By removing in advance the dissolved and existing gas in the liquid 1911 that is supplied, it is possible to dissolve the gas to the maximum in the gas dissolving unit 1930, to be described later.

The gas supply unit 1920 has a function to supply the gas that is dissolved in the liquid 1911. As the gas supply unit 1920, it may also be possible to use a device or the like capable of continuously producing the gas, in addition to a bomb storing the gas. For example, in a case where the gas that is dissolved is oxygen, it is possible to continuously generate oxygen and send the oxygen by a built-in pump by taking in the atmosphere and removing nitrogen that is not necessary.

The gas dissolving unit 1930 has a function to dissolve the gas supplied from the gas supply unit 1920 in a liquid 1941 supplied from the storage chamber 1940. For the gas that is supplied from the gas supply unit 1920, processing, such as discharging, is performed in a preprocessing unit 1932 and the gas is sent to a dissolving unit 1933 through a supply pipe 1931. On the other hand, the liquid 1941 is supplied through a pipe 1981 and in the dissolving unit 1933, the gas dissolves in the liquid 1941. Further, ahead of the dissolving unit 1933, an air-liquid separation chamber 1934 is arranged and the gas having been unable to dissolve in the dissolving unit 1933 is evacuated from an evacuation unit 1935. The solution is sent to the UFB generation unit 1960 through a pipe 1982. In the gas dissolving unit 1930, a solubility sensor, not shown schematically, is further incorporated.

The storage chamber 1940 has a function to store the liquid 1941. The liquid 1941 is, in more detail, a mixed liquid of the solution in which the gas is dissolved in the gas dissolving unit 1930 and a UFB-contained liquid that is generated by the UFB generation unit 1960, to be described later. In the storage chamber 1940, a liquid surface sensor 1942 is provided and at the time of the liquid 1911 being supplied from the liquid supply unit 1910, in a case where the liquid surface reaches the liquid surface sensor 1942, the supply is terminated. A cooling unit 1944 is arranged in the entire area or part of the area of the outer circumference of the storage chamber 1940 so that the liquid 1941 is cooled. The lower the liquid temperature, the higher the solubility of the gas can be increased, and therefore, it is preferable for the liquid temperature to be low. In the present embodiment, control is performed by a temperature sensor (not shown schematically) so that the temperature of the liquid 1941 is less than or equal to about 10° C.

The configuration of the cooling unit 1944 may be any one as long as capable of setting the liquid 1941 to a desired temperature and for example, it is possible to adopt a method or the like of circulating a coolant whose temperature is reduced by a chiller, not shown schematically, in addition to a cooling device, such as a Peltier device. The configuration that circulates the coolant may be a configuration in which a cooling pipe through which the coolant can circulate is attached so as to surround the outer circumference of the storage chamber 1940, or a configuration in which the container of the storage chamber 1940 has a hollow structure and the coolant flows through the hollow. Further, a configuration may also be accepted in which the cooling pipe is run through the liquid 1941.

By these configurations, the liquid 1941 is managed so as to be low in temperature and it is possible to maintain a state where the gas is likely to dissolve, and therefore, it is possible for the dissolving unit 1933 to efficiently dissolve the gas.

Inside the storage chamber 1940, a μm filter 1947 and a nm filter 1948 are arranged. By the μm filter 1947 and the nm filter 1948, the inside of the storage chamber 1940 is divided into three areas, that is, a UFB water output area 1940A, a UFB circulation blocking area 1940B, and a μB removal area 1940C.

As shown in FIG. 19, the output port of the liquid that is supplied from the liquid supply unit 1910 and the output port of the UFB-contained liquid that is supplied from the UFB generation unit 1960 are connected to the μB removal area 1940C and the input port to the gas dissolving unit 1930 is connected to the UFB circulation blocking area 1940B. By designing the configuration such as this, the μB and the UFB having occurred in the liquid supply unit 1910, the gas dissolving unit 1930, the UFB generation unit 1960, and a pump 1984 and the pump 1993 are not input to the circulation path again. Further, the μB rises in the storage chamber 1940 by the buoyant force and finally disappears by coming into contact with the atmosphere surface. As a result of that, the UFB concentration and the μB concentration in the liquid in the circulation path are reduced, and therefore, the UFB generation efficiency improves.

Further, an extraction port 1946 for extracting the UFB-contained liquid is arranged. The UFB concentration in the liquid 1941 is managed by a concentration sensor or the like, not shown schematically, and in a case where this UFB concentration reaches a predetermined threshold value, it is possible to extract the UFB-contained liquid by opening a valve 1945. It may also be possible to arrange the extraction port 1946 at an arbitrary position other than the storage chamber 1940, but it is preferable to arrange the extraction port 1946 so as to extract the UFB-contained liquid from the UFB water output area 1940A because the μB concentration in the UFB-contained liquid that is extracted is low. Further, it may also be possible to stir the inside of the storage chamber 1940 by using a stirrer or the like so as to eliminate unevenness of the temperature and the solubility of the liquid 1941.

The UFB generation unit 1960 has a function to generate (precipitate in a gas phase) the UFB from the gas dissolved and existing in the liquid 1941 that is supplied from the storage chamber 1940. As the method of generating the UFB, it may also be possible to adopt any method capable of generating the UFB, such as the venturi method, but in the present embodiment, in order to efficiently generate the high-definition UFB, the method (T-UFB method) of generating the UFB by applying the film boiling phenomenon is adopted. In the T-UFB method, film boiling is caused to take place by causing the heater unit to generate heat, but as explained previously, in the present embodiment, the liquid 1941 is controlled so as to maintain a low temperature of about 10° C. or less, and therefore, the liquid 1941 brings about the cooling effect of the UFB generation unit 1960. Consequently, it is possible to perform a continuous operation for a long time while preventing the temperature of the UFB generation unit 1960 from becoming high. In a case where many heaters are mounted and the amount of generated heat becomes large and only by the contact with the liquid 1941, the temperature becomes high, it is sufficient to separately provide a cooling mechanism in the UFB generation unit 1960.

To the UFB generation unit 1960, the liquid 1941 is supplied from the storage chamber 1940 through the pipe 1982 by the pump 1984. Further, at the upstream of the UFB generation unit 1960, a filter 1985 is arranged so as to make it possible to collect impurities, trash and the like, and thereby, impurities and trash are prevented from impeding generation of the UFB. Then, the UFB-contained liquid generated in the UFB generation unit 1960 is collected in the storage chamber 1940 through a pipe 1983.

FIG. 19 shows a case where the pump 1984 is arranged at the upstream of the UFB generation unit 1960, but the pump arrangement position is not limited to this and it is possible to arrange the pump 1984 at an arbitrary position so as to make it possible to efficiently generate the UFB. For example, it may also be possible to arrange the pump 1984 at the downstream of the UFB generation unit 1960 or at both the upstream and the downstream.

In the apparatus configuration explained above, the kinds of gas and liquid are not limited and it is possible to freely select gas and liquid. Further, it is preferable for the portion that comes into contact with gas or solution (specifically, the portion in contact with liquid, such as the pipes 1931, 1981, 1982, and 1983, the pump 1984, the filter 1985, the storage chamber 1940, and the UFB generation unit 1960) to be formed by a material with a strong corrosion resistance. For example, it is preferable to use a fluorine resin, such as polytetrafluoroethylene (PTFE) and perfluoroalkoxyalkane (PFA), a metal, such as SUS316L, and other inorganic materials. By using these materials, it is possible to preferably generate the UFB even in a case where the gas and liquid are highly corrosive. Further, as the pump 1984, it is desirable to use a pump whose variation in pulsation and flow rate is small so that the UFB generation efficiency is not impaired. Due to this, it is possible to efficiently generate the UFB-contained liquid whose variation in the UFB concentration is small.

Next, a specific example of generation of the UFB-contained liquid using the UFB generation apparatus in the present embodiment is explained. By the configuration described above, in the UFB generation apparatus in the present embodiment, the circulation path in which the liquid 1941 flows from the storage chamber 1940 through the gas dissolving unit 1930, the UFB generation unit 1960, and the storage chamber 1940 to the storage chamber 1940 is formed.

In a case where the temperature of the liquid 1941 drops to a predetermined temperature, first, circulation of the liquid 1941 under first circulation conditions is performed by operating only the gas supply unit 1920. In the present embodiment, the first circulation conditions are set such that the flow velocity is about 500 to 3,000 mL/min and the pressure is about 0.2 to 0.6 MPa in order to efficiently dissolve the gas. At this time, the UFB generation unit 1960 is also in the same circulation path, and therefore, in a case where the method of the UFB generation unit 1960 is a method in which the UFB is generated by the liquid passing through a specific shape portion, such as a nozzle, there is a possibility that a bubble whose size is not intended in this circulation process is generated. However, as described previously, in the present embodiment, the T-UFB method is adopted, and therefore, the problem such as this does not arise. The reason is that the T-UFB method generates the UFB by making use of film boiling at the time of a fine heater being driven, and therefore, no UFB is generated unless the heater is driven.

In a case where the solubility of the gas in the liquid 1941 reaches a predetermined threshold value, the circulation and the operation of the gas supply unit 1920 under the first circulation conditions are terminated. Then, circulation of the liquid 1941 under second circulation conditions is performed as well as driving the UFB generation unit 1960. In the present embodiment, the second circulation conditions are set such that the flow velocity is about 30 to 150 mL/min and the pressure is about 0.1 to 0.2 MPa. In the T-UFB method, the UFB is generated by making use of a pressure difference and heat that occur in the process between foaming by film boiling and bubble disappearance, and therefore, as the circulation conditions, comparatively low velocity and low pressure (atmospheric pressure) are preferable.

After the start of the circulation of the liquid 1941 under the second circulation conditions, in a case where the UFB concentration in the liquid 1941 reaches a predetermined threshold value, the UFB-contained liquid is extracted. At the time of extracting the UFB-contained liquid, it may also be possible to extract all within the storage chamber 1940 or part thereof After that, it is sufficient to repeat the processes described previously until the necessary amount is reached.

As above, in the present embodiment, the liquid is circulated under the two different conditions, that is, the first circulation conditions and the second circulation conditions, and each process of the gas dissolving and the UFB generation is performed under the optimum conditions, respectively. Due to this, it is possible to efficiently generate a high-concentration UFB-contained liquid.

In the present embodiment, the case is explained where the μm filter and the nm filter explained in the fourth embodiment are used is explained, but also by the form that combines the electric field control explained in the first embodiment and the third embodiment with the case, it is possible to obtain the effect of the present disclosure. Further, the effect of the embodiments explained so far exhibits a particularly great effect in a combination with the T-UFB, but even by the conventional UFB generation method, such as the already-existing venturi method and the fine air bubble injection method, it is possible to expect the same effect.

<Improvement of Circulation Efficiency>

Figure 20A:
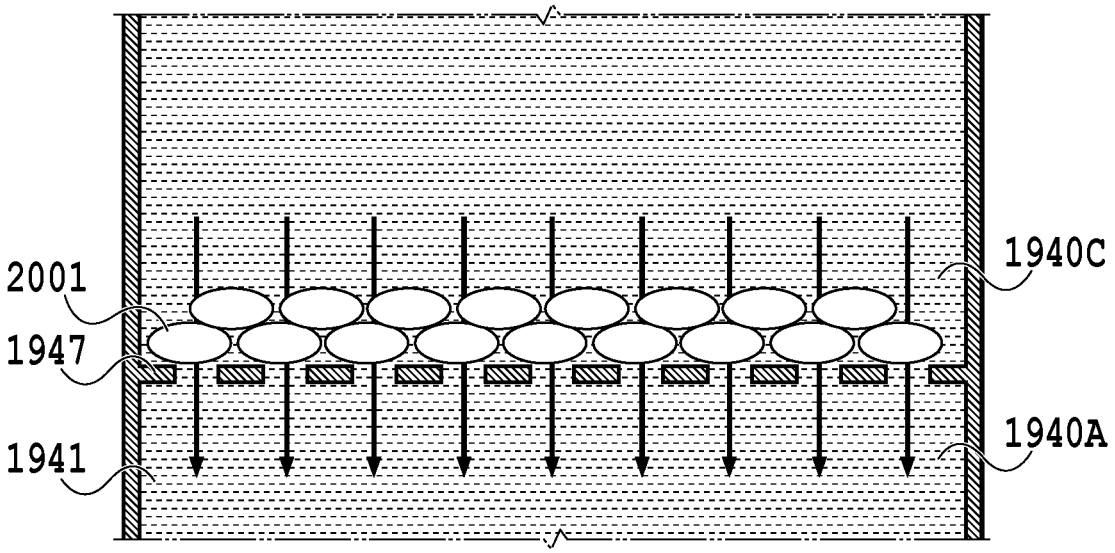
FIG. 20A and FIG. 20B are diagrams for explaining a method of improving a liquid circulation efficiency in the fifth embodiment.

In the following, a method of improving the liquid circulation efficiency in the UFB generation apparatus is explained by using FIG. 20A and FIG. 20B. FIG. 20A is an enlarged diagram in the storage chamber 1940 in FIG. 19. The liquid 1941, the μB filter 1947, the μB removal area 1940C, and the UFB water output area 1940A in FIG. 20A are the same as those in FIG. 19, and therefore, explanation is omitted. Sign 2001 in FIG. 20A indicates a μB (micro bubble).

FIG. 20A shows a case where the flow of the liquid 1941 within the storage chamber 1940 exists mainly vertically with respect to the μm filter 1947. As shown schematically, a μB 2001 is laminated onto the μB filter 1947 and the μB 2001 block the hole of the μB filter 1947 and as a result of that, the circulation speed of the liquid in the entire UFB generation apparatus is reduced.

Figure 20B:
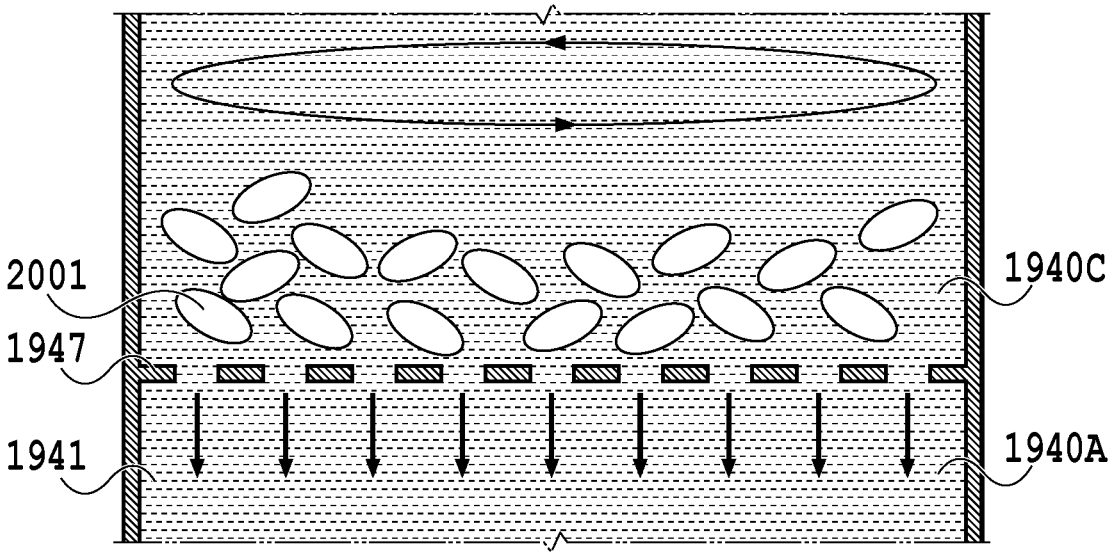

FIG. 20B shows the configuration for solving the problem shown in FIG. 20A. In this configuration, a stirrer, not shown schematically, stirs the liquid 1941 within the storage chamber 1940, particularly within the μB removal area 1940C in the direction of the arrow and as a result of that, the flow of the liquid 1941 mainly horizontal with respect to the μm filter 1947 within the μB removal area 1940C occurs. By this flow, the μB filter 1947 becomes unlikely to be laminated by the μB 2001 because the μB 2001 circulates within the μB removal area 1940C. Consequently, it is possible to reduce the occurrence probability of the situation in which the μB 2001 blocks the hole of the μm filter 1947 and suppress a reduction in the liquid circulation speed.

Further, by making the diameter of the UFB water output area 1940A small compared to that of the μB removal area 1940C, it is possible to increase the flow velocity in the UFB water output area 1940A. By receiving the flow velocity increasing effect in the UFB water output area 1940A, in addition to the stirring effect shown in FIG. 20B, it is possible to further suppress a reduction in the liquid circulation speed.

In FIG. 20B, the stirring direction is set horizontal with respect to the μm filter 1947, but the complete horizontality is not necessarily required. In a case where it is possible to cause a flow, even a little, of the liquid in the horizontal direction to occur, the effect of suppressing a reduction in the liquid circulation speed is obtained by the stirring in any direction.

Further, the larger the amount of the μm 2001, the more the liquid circulation speed is reduced because the μm 2001 is deposited onto the μm filter 1947. However, the T-UFB generation method itself, which is adopted in the present embodiment, is originally unlikely to cause a reduction in the circulation speed because the UFB ratio in the bubble that is generated is very high, and therefore, it can be said that the T-UFB generation method is a method by which it is possible to stably and easily obtain the effect of the μm filter 1947 for a long time.

Further, it may also be possible to similarly provide the stirring mechanism within the UFB circulation blocking area 1940B and make the diameter of the UFB circulation blocking area 1940B small compared to that of the UFB water output area 1940A. By designing the configuration such as this, it is possible to suppress a reduction in the liquid circulation speed, which results from the UFB being deposited onto the nm filter 1948. It may also be possible to use the components shown in the first embodiment to the fifth embodiment in an appropriate combination.

<<Liquid and Gas that can be Used for T-UFB-Contained Liquid>>

Here, the liquid W that can be used for generating the T-UFB-contained liquid is explained. As the liquid W that can be used in the present embodiments, mention is made of, for example, pure water, deionized water, distilled water, bioactive water, magnetically activated water, lotion, tap water, seawater, river water, service and waste water, lake water, groundwater, rain water and the like. Further, it is also possible to use a mixed liquid including these liquids and the like. Furthermore, it is also possible to use a mixed solvent of water and a water-soluble organic solvent. The water-soluble organic solvent that is used by being mixed with water is not limited in particular and as specific examples, mention is made of as follows. Alkyl alcohols whose carbon number is 1 to 4, such as methyl alcohol, ethyl alcohol, n-propyl alcohol, isopropyl alcohol, n-butyl alcohol, sec-butyl alcohol, and tert-butyl alcohol. Amides, such as N-methyl-2-pyrrolidone, 2-pyrrolidone, 1,3-dimethyl-2-imidazolidinone, N,N-dimethylformamide, and N,N-dimethylacetamide. Ketone or ketoalcohols, such as acetone and diacetone alcohol. Cyclic ethers, such as tetrahydrofuran and dioxane. Glycols, such as ethylene glycol, 1,2-propylene glycol, 1,3-propylene glycol, 1,2-butanediol, 1,3-butanediol, 1,4-butanediol, 1,5-pentanediol, 1,2-hexanediol, 1,6-hexanediol, 3-methyl-1,5-pentanediol, diethylene glycol, triethylene glycol, and thiodiglycol. Lower alkyl ethers of multivalent alcohols, such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether. Polyalkylene glycols, such as polyethylene glycol and polypropylene glycol. Triols, such as glycerin, 1,2,6-hexanetriol, and trimethylolpropane. These water-soluble organic solvents can be used alone or two or more kinds may be used together.

As the gas component that can be introduced in the dissolving unit 200, mention is made of, for example, hydrogen, helium, oxygen, nitrogen, methane, fluorine, neon, carbon oxide, ozone, argon, chlorine, ethane, propane, air and the like. Further, a mixed gas including some of those described above may be accepted. Furthermore, it is not necessarily required to dissolve a material in a gas state in the dissolving unit 200 and it may also be possible to fuse a liquid or a solid including a desired component in the liquid W. As dissolving in this case, in addition to natural dissolving, dissolving by attaching a pressure may be accepted and dissolving accompanied by hydration by electrolytic dissociation, ionization, and chemical reaction may be accepted.

<<Effect of T-UFB Generation Method>>

Next, features and effect of the T-UFB generation method explained above are explained in comparison to the conventional T-UFB generation method. For example, in the conventional air bubble generation apparatus represented by the venturi method, a mechanical depressurizing structure, such as a depressurizing nozzle, is provided at a part in the flow path and by causing a liquid to flow by a predetermined pressure so as to pass through the depressurizing structure, air bubbles of a variety sizes are generated in an area at the downstream of the depressurizing structure.

In this case, among the generated air bubbles, on the bubbles whose size is comparatively large, such as milli-bubbles and micro bubbles, the buoyant force acts, and therefore, they soon float up to the liquid surface and become extinct. Further, there is a case where the UFB on which the buoyant force does not act becomes extinct together with the milli-bubble and the micro bubble because of not having so large an air-liquid interface energy. In addition, even by arranging the above-described depressurizing structure in series and causing the same liquid to flow repeatedly through the depressurizing structure, it is not possible to preserve the UFBs corresponding to the number of times of repetition for a long time. That is, it is difficult for the UFB-contained liquid generated by the conventional UFB generation method to keep the UFB content concentration at a predetermined value for a long time.

In contrast to this, in the T-UFB generation method of the present embodiment, which makes use of film boiling, a sudden change in temperature, such as a change from the normal temperature to about 300° C., and a sudden change in pressure, such as from the normal pressure to about several MPa, are caused to occur locally in the close vicinity of the heating element. The heating element has a shape of square whose side is about several tens of μm to several hundred Compared to the size of that in the conventional UFB generator, the size is about 1/10 to 1/1000. Further, the UFB precipitates by the gas-dissolved liquid existing in the very thin film area on the surface of the film boiling bubble exceeding the thermal solubility limit or the pressure solubility limit instantaneously (in a very short time less than or equal to microsecond) to cause a phase transition to take place. In this case, almost no bubble whose size is comparatively large, such as the milli-bubble or micro bubble, occurs and in the liquid, the UFB whose diameter is about 100 nm is contained in a very high purity. Further, the T-UFB thus generated has a sufficiently high air-liquid interface energy, and therefore, the T-UFB is unlikely to be destroyed in the normal environment and it is possible to preserve the T-UFB for a long time.

In particular, with the present disclosure that uses the film boiling phenomenon capable of forming the gas interface locally for the liquid, it is possible to form the interface in a part of the liquid existing in the vicinity of the heating element without affecting the entire liquid area and make the area that acts in terms of heat and pressure accompanying thereto a very local range. As a result of that, it is possible to generate the desired UFB stably. Further, by attaching a generation condition of the UFB to the generated liquid by circulating the liquid, it is possible to additionally generate a new UFB with a less influence on the already-existing UFB. As a result of that, it is possible to manufacture the UFB liquid with the desired size and concentration comparatively easily.

Further, the T-UFB generation method has the above-described hysteresis characteristic, and therefore, it is possible to increase the content concentration up to a desired concentration while keeping a high purity, That is, according to the T-UFB generation method, it is possible to efficiently generate a UFB-contained liquid having a high purity and a high concentration and which can be preserved for a long time. <<Specific Use of T-UFB-Contained Liquid>>

Generally, the use of the ultra fine bubble-contained liquid is distinguished according to the kind of gas that is contained. Any gas that can be dissolved in a liquid by an amount about PPM to BPM can be turned into a UFB. As an example, it is possible to apply the UFB to the following uses.

It is possible to preferably use the UFB-contained liquid in which air is contained for industrial, agriculture and fishery industrial, and medical cleaning and for raising plants and agricultural and marine products.

It is possible to preferably use the UFB-contained liquid in which ozone is contained for the purpose of disinfection, sterilization, and dezymotization, in addition to the industrial, agriculture and fishery industrial, and medical cleaning, and for purification of the environment, such as draining and contaminated soil.

It is possible to preferably use the UFB-contained liquid in which nitrogen is contained for the purpose of disinfection, sterilization, and dezymotization, in addition to the industrial, agriculture and fishery industrial, and medical cleaning, and for purification of the environment, such as draining and contaminated soil.

It is possible to preferably use the UFB-contained liquid in which oxygen is contained for raising plants and agricultural and marine products, in addition to industrial, agriculture and fishery industrial, and medical cleaning.

It is possible to preferably use the UFB-contained liquid in which carbon dioxide is contained for the purpose of disinfection, sterilization, and dezymotization, in addition to the industrial, agriculture and fishery industrial, and medical cleaning.

It is possible to preferably use the UFB-contained liquid in which perfluorocarbon, which is a medical gas, for the ultrasonic diagnosis and treatment. As described above, it is possible for the UFB-contained liquid to show the effect across a wide-ranging field, such as medical treatment, medicine, dental surgery, food, industry, and agriculture and fishery industry.

Then, in order to show the effect of the UFB-contained liquid both quickly and securely in each use, the purity and concentration of the UFB included in the UFB-contained liquid are important. That is, by making use of the T-UFB generation method of the present embodiment, which is capable of generating the UFB-contained liquid having a high purity and a desired concentration, it is possible to expect the effect more significant than before in a variety of fields. In the following, uses to which it is supposed that the T-UFB generation method and the T-UFB-contained liquid can be applied preferably are enumerated.

(A) Use for Refinement of Liquid

By arranging the T-UFB generation unit in a purifier, it is possible to expect to magnify the water purifying effect and the refining effect of the PH preparation liquid. Further, it is also possible to arrange the T-UFB generation unit in a carbonated water server.

By arranging the T-UFB generation unit in a humidifier, an aroma diffuser, a coffee make and the like, it is possible to expect to magnify the humidifying effect, the deodorizing effect and the fragrance diffusing effect in a room.

By generating the UFB-contained liquid in which the ozone gas is dissolved in the dissolving unit and using this for dental treatment, treatment of a burn, treatment of a hurt at the time of use of an endoscope, and the like, it is possible to expect to magnify the medical cleaning effect and the disinfecting effect.

By arranging the T-UFB generation unit in a water tank of a housing complex, it is possible to expect to magnify the purifying effect and the chlorine removing effect of drinking water that is preserved for a long time.

By using the UFB-contained liquid containing ozone and carbon dioxide in the sake brewing process of sake, shochu, wine and the like in which it is not possible to perform high-temperature disinfection processing, it is possible to expect to perform low-temperature disinfection processing more efficiently than before.

By mixing the UFB-contained liquid in the material in the manufacturing process of food for specified health use and food with functional claims, it is made possible to perform low-temperature disinfection processing and it is possible to provide safe and functional food without reducing flavor.

By arranging the T-UFB generation unit in the supply path of seawater or fresh water for aquaculture in an aquaculture farm of fish and shellfish, such as fish and pearls, it is possible to expect to facilitate egg-laying and growth of fish and shellfish.

By arranging the T-UFB generation unit in the refinement process of foodstuff preservation water, it is possible to expect to improve the foodstuff preservation state.

By arranging the T-UFB generation unit in a decolorizer for decolorizing pool water and underground water, it is possible to expect a higher decolorizing effect.

By using the UFB-contained liquid for repairing a crack of a concrete member, it is possible to expect improvement of the crack repairing effect.

By containing the T-UFB in the liquid fuel of an apparatus (automobile, ship, aircraft) that uses the liquid fuel, it is possible to expect to improve the fuel energy efficiency.

(B) Use for Washing

In recent years, as the washing water for removing stains and the like that have stuck to clothes, the UFB-contained liquid is attracting attention. By arranging the T-UFB generation unit explained in the embodiments described above in a washing machine and supplying the UFB-contained liquid having a purity higher than before and excellent in permeability in the washing layer, it is possible to expect to further improve the detergency.

By arranging the T-UFB generation unit in a bathroom shower or a toilet stool washer, it is possible to expect the effect of facilitating the removal of contamination, such as scale and mold in a bathroom or on a toilet stool, in addition to the washing effect of the human body and the like and all of the living things.

By arranging the T-UFB generation unit in a wind washer of an automobile and the like, a high-pressure washing machine for washing wall materials, a car wash, a dish washer, a foodstuff washer and the like, it is possible to expect to further improve the washing effect, respectively.

By using the UFB-contained liquid at the time of washing and maintaining parts manufactured in a factory in the deburring process after the presswork and the like, it is possible to expect to improve the washing effect.

By using the UFB-contained liquid as the polishing water of a wafer at the time of manufacturing of a semiconductor element, it is possible to expect to improve the polishing effect. Further, in the resist removal process, by using the UFB-contained liquid, it is possible to expect to facilitate flaking off of the resist hard to flake off.

By arranging the T-UFB generation unit in a device for washing and disinfecting a medical instrument, such as a medical robot, a dental treatment instrument, and a preserving container of an internal organ, it is possible to expect improvement of the washing effect and the disinfecting effect of these instruments. Further, it is also possible to apply the T-UFB generation unit to the treatment of a living thing.

(C) Use for Medical Product

By containing the T-FUB-contained liquid in cosmetics and the like, it is possible to significantly reduce additives, such as antiseptic substances and surfactants, which adversely affect the skin, as well as facilitating permeation into subcutaneous cells. As a result of that, it is possible to provide safe and functional cosmetics.

By making use of a high-concentration nano bubble preparation containing the T-UFB for the contrast medium of a medical examination instrument, such as CT and MRI, it is possible to efficiently make use of reflected light by x-rays or ultrasonic waves and it is possible to obtain a more detailed captured image and it is possible to make use for the initial diagnosis of a malignant tumor.

By using high-concentration nano bubble water containing the T-UFB in an ultrasonic wave treatment instrument called HIFU (High Intensity Focused Ultrasound), it is possible to reduce the irradiation power of ultrasonic waves and it is possible to perform treatment more nonoperatively. In particular, it is made possible to reduce damage to the normal tissue It is possible to crate a nano bubble preparation to which various medical substances (DNA, RAN and the like) are attached by taking a high-concentration nano bubble containing the T-UFB as species and modifying the phosphatide that forms a liposome in a negative charge area around the air bubble and via the phosphatide.

By sending a medicine including high-concentration nano bubble water by T-UFB generation into a dental canal as treatment to reproduce a dental pulp or dentin, the medicine permeates deeply into the dental canaliculus by the permeation action of the nano bubble water to facilitate dezymotizing effect and it is possible to perform the infected pulp canal treatment of the dental pulp safely in a short time.

According to one embodiment of the present invention, in a generation apparatus having a circulation mechanism, it is made possible to improve the generation efficiency of a UFB-contained liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-021438, filed Feb. 12, 2020, which is hereby incorporated by reference wherein in its entirety.

What is claimed is:

1. An ultra fine bubble generation apparatus comprising:

a first tank that stores a liquid;

a generation unit configured to generate an ultra fine bubble in the liquid output from the first tank;

a second tank that stores the liquid output from the generation unit; and a liquid passage that inputs again the liquid stored in the second tank to the first tank, wherein the ultra fine bubble generation apparatus includes a blocking configuration that blocks an ultra fine bubble included in the stored liquid from being input again to the first tank.

2. The ultra fine bubble generation apparatus according to claim 1, wherein the generation unit includes a heater that causes film boiling to take place by heating the liquid.

3. The ultra fine bubble generation apparatus according to claim 1, further comprising:

an output unit configured to output the liquid stored in the second tank and a pump that inputs again the liquid stored in the second tank to the first tank, wherein the second tank is connected with the pump, the generation unit, and the output unit.

4. The ultra fine bubble generation apparatus according to claim 3, wherein the blocking configuration is a set of electrodes arranged inside or outside the second tank.

5. The ultra fine bubble generation apparatus according to claim 4, wherein by an electric field generated by the set of electrodes, the ultra fine bubble included in the liquid stored in the second tank is guided to a side of the output unit under the pump and the generation unit.

6. The ultra fine bubble generation apparatus according to claim 4, wherein by an electric field generated by the set of electrodes, the ultra fine bubble included in the liquid stored in the second tank is guided in a direction opposite to a flow of circulation in the second tank.

7. The ultra fine bubble generation apparatus according to claim 3, wherein the blocking configuration is a first filter whose mesh is smaller than a diameter of the ultra fine bubble, which is installed inside the second tank.

8. The ultra fine bubble generation apparatus according to claim 7, wherein the second tank is divided by the first filter into a first area to which the pump is connected and a second area in which the ultra fine bubble exists.

9. The ultra fine bubble generation apparatus according to claim 8, wherein the generation unit and the output unit are connected to the second area.

10. The ultra fine bubble generation apparatus according to claim 4, wherein in the second tank, an air-liquid interface exists.

11. The ultra fine bubble generation apparatus according to claim 10, wherein in a case where a micro bubble that rises by a buoyant force reaches the air-liquid interface, the micro bubble having reached the air-liquid interface becomes extinct by coming into contact with a gas.

12. The ultra fine bubble generation apparatus according to claim 10, wherein an electromagnetic induction force of an electric field generated by the set of electrodes is less than or equal to half a buoyant force of a micro bubble.

13. The ultra fine bubble generation apparatus according to claim 10, wherein in the set of electrodes, a negative electrode is arranged on a side in a vertically upward direction of a positive electrode.

14. The ultra fine bubble generation apparatus according to claim 7, wherein there is an air-liquid interface in the second tank, and wherein a second filter whose mesh is smaller than a diameter of a micro bubble but larger than a diameter of the ultra fine bubble is installed inside the second tank.

15. The ultra fine bubble generation apparatus according to claim 14, wherein the first filter and the second filter divide the second tank into a first area in which both the ultra fine bubble and the micro bubble exist, a second area to which the output unit is connected, and a third area to which the pump is connected.

16. The ultra fine bubble generation apparatus according to claim 15, wherein the generation unit is connected to the first area.

17. The ultra fine bubble generation apparatus according to claim 16, wherein the first tank and the second tank are integrated into one.

18. The ultra fine bubble generation apparatus according to claim 17, further comprising:

a stirring mechanism that stirs the first area.

19. The ultra fine bubble generation apparatus according to claim 18, wherein a diameter of the second area is smaller than a diameter of the first area.

* * * * *